US007661667B2

(12) United States Patent
Tsutsui

(10) Patent No.: US 7,661,667 B2
(45) Date of Patent: Feb. 16, 2010

(54) CONVEYOR BELT, SHEET FEEDING DEVICE, AND IMAGE FORMING APPARATUS INCLUDING THE SHEET FEEDING DEVICE

(75) Inventor: Kazuya Tsutsui, Tokyo (JP)

(73) Assignee: Ricoh Co., Ltd., Tokyo (JP)

( * ) Notice: Subject to any disclaimer, the term of this patent is extended or adjusted under 35 U.S.C. 154(b) by 539 days.

(21) Appl. No.: 11/124,355

(22) Filed: May 9, 2005

(65) Prior Publication Data

US 2005/0248083 A1 Nov. 10, 2005

(30) Foreign Application Priority Data

| | | |
|---|---|---|
| May 7, 2004 | (JP) | 2004-138668 |
| Aug. 23, 2004 | (JP) | 2004-241798 |
| Sep. 10, 2004 | (JP) | 2004-264441 |
| Apr. 4, 2005 | (JP) | 2005-107645 |
| Apr. 4, 2005 | (JP) | 2005-107650 |
| Apr. 6, 2005 | (JP) | 2005-109430 |

(51) Int. Cl.

| | |
|---|---|
| ***B65H 29/66*** | (2006.01) |
| ***B65H 29/68*** | (2006.01) |
| ***B65H 5/22*** | (2006.01) |
| ***B65H 43/04*** | (2006.01) |
| ***B65G 23/06*** | (2006.01) |
| ***B65G 23/04*** | (2006.01) |

(52) U.S. Cl. ..... 271/65; 271/67; 271/7; 271/198; 198/835; 198/834

(58) Field of Classification Search ..... 271/275, 271/7, 69, 198, 67; 198/835, 834, 861.1
See application file for complete search history.

(56) References Cited

U.S. PATENT DOCUMENTS

| | | | | |
|---|---|---|---|---|
| 3,980,174 | A * | 9/1976 | Conrad | 198/835 |
| 4,072,062 | A * | 2/1978 | Morling et al. | 198/834 |
| 4,397,538 | A * | 8/1983 | Castelli et al. | 399/165 |

(Continued)

FOREIGN PATENT DOCUMENTS

| | | |
|---|---|---|
| JP | 58-102536 | 7/1983 |

(Continued)

OTHER PUBLICATIONS

Korean Patent Abstracts, KR 10-2002-0049190, Jun. 26, 2002.

*Primary Examiner*—Patrick H Mackey
*Assistant Examiner*—Patrick Cicchino
(74) *Attorney, Agent, or Firm*—Oblon, Spivak, McClelland, Maier & Neustadt, L.L.P.

(57) ABSTRACT

A sheet feeding device includes a conveyor belt having a first row of a plurality of convex portions intermittently arranged on an inner circumferential surface of the conveyor belt in a sheet conveying direction. The sheet feeding device further includes a plurality of rollers around which the conveyor belt is spanned such that a direction substantially perpendicular to the sheet conveying direction is parallel to an axial direction of each of the rollers. The rollers include concave portions on outer circumferential surfaces thereof, in which the convex portions of the first row of the conveyor belt are engaged. The concave portion of at least one roller of the plurality of rollers has a width different from a width of each of the plurality of rollers other than the at least one roller.

18 Claims, 22 Drawing Sheets

U.S. PATENT DOCUMENTS

| | | | | |
|---|---|---|---|---|
| 5,017,969 | A * | 5/1991 | Mitomi et al. | 399/299 |
| 5,531,436 | A * | 7/1996 | Ohyama et al. | 271/275 |
| 6,109,427 | A * | 8/2000 | Hosch et al. | 198/835 |
| 6,145,827 | A * | 11/2000 | Harada et al. | 271/3.01 |
| 6,305,681 | B1 | 10/2001 | Watanabe et al. | |
| 6,564,932 | B2 * | 5/2003 | Itoh | 198/835 |
| 6,594,460 | B1 * | 7/2003 | Williams et al. | 399/165 |
| 6,832,759 | B2 | 12/2004 | Nagasako et al. | |
| 6,871,851 | B2 | 3/2005 | Tamura et al. | |
| 7,021,457 | B1 * | 4/2006 | Schiltz | 198/835 |
| 7,021,756 | B2 * | 4/2006 | Nakashima et al. | 347/104 |
| 7,124,879 | B1 * | 10/2006 | Maguire | 198/690.2 |
| 7,270,232 | B2 * | 9/2007 | Schiltz | 198/835 |
| 2002/0063380 | A1 | 5/2002 | Tamura et al. | |
| 2003/0006543 | A1 | 1/2003 | Tamura et al. | |
| 2004/0089519 | A1 * | 5/2004 | Pollak et al. | 198/834 |

FOREIGN PATENT DOCUMENTS

| | | |
|---|---|---|
| JP | 64-18191 | 1/1989 |
| JP | 4-24773 | 2/1992 |
| JP | 05-139564 | 6/1993 |
| JP | 05294494 | * 11/1993 |
| JP | 06087547 | * 3/1994 |
| JP | 07-315614 | 12/1995 |
| JP | 2003-95472 | 4/2003 |
| JP | 2003-095472 | 4/2003 |
| JP | 2003-215943 | 7/2003 |

* cited by examiner

CONVEYOR BELT, SHEET FEEDING DEVICE, AND IMAGE FORMING APPARATUS INCLUDING THE SHEET FEEDING DEVICE

CROSS-REFERENCE TO RELATED APPLICATIONS

This application claims priority to Japanese Patent Application No. 2004-138668 filed in the Japanese Patent Office on May 7, 2004, Japanese Patent Application No. 2004-241798 filed in the Japanese Patent Office on Aug. 23, 2004, Japanese Patent Application No. 2004-264441 filed in the Japanese Patent Office on Sep. 10, 2004, Japanese Patent Application No. 2005-107650 filed in the Japanese Patent Office on Apr. 4, 2005, Japanese Patent Application No. 2005-107645 filed in the Japanese Patent Office on Apr. 4, 2005, and Japanese Patent Application No. 2005-109430 filed in the Japanese Patent Office on Apr. 6, 2005, the entire contents of which are incorporated by reference herein.

BACKGROUND OF THE INVENTION

1. Field of the Invention

The present invention relates to a conveyor belt, a sheet feeding device including the conveyor belt, and an image forming apparatus including the sheet feeding device, such as, a copying machine, a printer, a facsimile machine, or other similar image forming apparatuses.

2. Discussion of the Background

An image forming apparatus such as, a copying machine, a printer, a facsimile machine, or other similar image forming apparatuses, uses a sheet feeding device that feeds original documents having images to be read by an image reading device to an image reading position and conveys the original documents toward an image forming device. The sheet feeding device has a sheet-through mechanism in which an original document is fed so as to pass over a stationary image reading device. An image of an original document, which has been conveyed onto a slit glass, is read by the stationary image reading device at the image reading position while moving the original document relatively to the image reading device.

In the sheet feeding device, several original documents out of a stack of original documents (hereafter referred to as "sheets"), which are stacked on an original document setting table, are picked up and fed by a sheet pick-up roller, and then fed one by one by a sheet feeding belt and a reverse roller provided downstream of the sheet pick-up roller in the sheet feeding direction. Then, the fed sheet is conveyed to the image reading position through a sheet conveying path in the sheet feeding device. A part of the sheet conveying path is formed between a conveyor belt and the slit glass, through which the fed sheet is conveyed to the image reading position. The conveyor belt is in a circular shape and spanned around a plurality of rollers.

In the above-described background sheet feeding device, the conveyor belt typically shifts in a direction perpendicular to the sheet conveying direction, that is, in the direction along the width of the belt, during rotation. To avoid a shift of the conveyor belt, a background sheet feeding device uses plates to regulate end portions of the conveyor belt in a direction perpendicular to the sheet conveying direction. In this background sheet feeding device, abrasion powder is typically produced between contact surfaces of the conveyor belt and the regulating plates. If abrasion powders scatter on a slit glass and a contact glass, spot and streak occur in the image of an original document read by an image reading device.

In another background sheet feeding device, a line of convex portions are provided on an inner circumferential surface of the conveyor belt in order to avoid shifting. The convex portions engage in concave portions formed on outer circumferential surfaces of a plurality of rollers, respectively. In this type of background sheet feeding device, a contracting force is produced in the direction of the belt's width due to the tension caused by the rollers and exerted in an extending direction of the conveyor belt. Then, a reaction force against the contracting force is exerted in the outer circumferential direction of the conveyor belt. Consequently, as illustrated in FIG. 1, a circular portion 802 of a conveyor belt 801, where a line of convex portions are provided on an inner circumferential surface of the conveyor belt 801, may be protruded toward its outer circumferential surface side. As a result, flatness of the outer circumferential surface of the conveyor belt 801 is impaired, resulting in a sheet conveyance failure such as a sheet skew. If such a sheet conveyance failure occurs at an image reading position, an image of the original document cannot be properly read by the image reading device, resulting in deterioration of image quality. In FIG. 1, the conveyor belt 801 is spanned around a drive roller 803, a pressure roller 804, and a driven roller 805.

Further, in another background sheet feeding device, convex portions each having a trapezoid shape are fixed on an inner circumferential surface of the conveyor belt to avoid shifting. The conveyor belt is spanned around a plurality of rollers, and the convex portions of the conveyor belt engage a timing pulley formed on an end portion of each of the rollers. In this background sheet feeding device, because a plurality of grooves of the timing pulley have uniform intervals, the convex portions of the conveyor belt need to be attached to the timing pulleys of the rollers accurately, thus also requiring a high degree of accuracy in the processing of parts, which results on an increase of the overall cost of the device.

In the above-described background sheet feeding device in which the convex portions of the conveyor belt engage in the concave portions of the rollers, the concave portions of the rollers need to be in proper alignment with each other in the sheet conveying direction to securely engage with the convex portions of the conveyor belt. If the concave portions of the rollers are not aligned properly in the sheet conveying direction, the convex portions of the conveyor belt may disengage from the concave portions of the rollers and go on the outer circumferential surfaces of the rollers as the conveyor belt rotates, thereby causing the conveyor belt to shift in the direction perpendicular to the sheet conveying direction. As a result, the conveyor belt cannot convey a sheet stably. Practically, it is difficult to align the concave portions of the rollers in the sheet conveying direction of the conveyor belt due to variations in accuracy of parts and attachments.

SUMMARY

According to an aspect of the present invention, a sheet feeding device includes a conveyor belt that conveys a sheet and includes a first row of a plurality of convex portions intermittently arranged on an inner circumferential surface of the conveyor belt in a sheet conveying direction. The sheet feeding device further includes a plurality of rollers around which the conveyor belt is spanned such that a direction substantially perpendicular to the sheet conveying direction is parallel to an axial direction of each of the rollers. The rollers include concave portions on outer circumferential surfaces thereof, respectively, in which the convex portions of the first row of the conveyor belt are engaged. The concave portion of at least one roller of the plurality of rollers has a width different from a width of each of the plurality of rollers other than the at least one roller.

According to an aspect of the present invention, an image forming apparatus includes an image reading device configured to read an image of an original document at an image reading position, an image forming device configured to form a duplicate of the image read by the image reading device, and the above-described sheet feeding device that feeds the original document to the image reading position.

According to yet another aspect of the present invention, a sheet feeding device that feeds an original document to an image reading position of an image reading device includes an endless conveyor belt configured to convey an original document to the image reading position. The conveyor belt includes a row of a plurality of convex portions arranged on an inner circumferential surface of the conveyor belt in a circumferential direction thereof. The sheet feeding device further includes a plurality of rollers disposed at positions upstream and downstream of the image reading position in an original document conveying direction around which the conveyor belt is spanned. The rollers include concave portions, in which respective convex portions of the conveyor belt are engaged. At least surfaces of the concave portions of the rollers are made of a material having a smooth surface.

According to yet another aspect of the present invention, an image forming apparatus includes an image reading device configured to read an image of an original document at an image reading position, an image forming device configured to form a duplicate of the image read by the image reading device, and the above-described sheet feeding device that feeds the original document to the image reading position.

According to yet another aspect of the present invention, an endless conveyor belt spanned around a plurality of rollers and rotated by rotations of the plurality of rollers includes a plurality of convex portions provided on an inner circumferential surface of the conveyor belt in a row extending in a circumferential direction of the conveyor belt. Each of the convex portions includes a base portion. The conveyor belt further includes at least one recess portion provided on an outer circumferential surface of the conveyor belt at a position opposing the base portion of each of the convex portions.

According to yet another aspect of the present invention, a sheet feeding device includes a plurality of rollers configured to rotate. Each of the rollers includes a concave portion. The sheet feeding device further includes an endless conveyor belt spanned around and rotated by the plurality of rollers to convey a sheet. The conveyor belt includes a plurality of convex portions provided on an inner circumferential surface of the conveyor belt in a row extending in the circumferential direction of the conveyor belt. Each of the convex portions includes a base portion and engages in the concave portion of each of the rollers. A shift of the conveyor belt in a direction along its width is regulated by engagement between the convex portions and the concave portion of each of the rollers. The conveyor belt further includes at least one recess portion provided on an outer circumferential surface of the conveyor belt at a position opposing the base portion of each of the convex portions.

According to yet another aspect of the present invention, an image forming apparatus includes an image reading device configured to read an image of an original document at an image reading position, an image forming device configured to form a duplicate of the image read by the image reading device, and the above-described sheet feeding device that feeds the original document to the image reading position.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
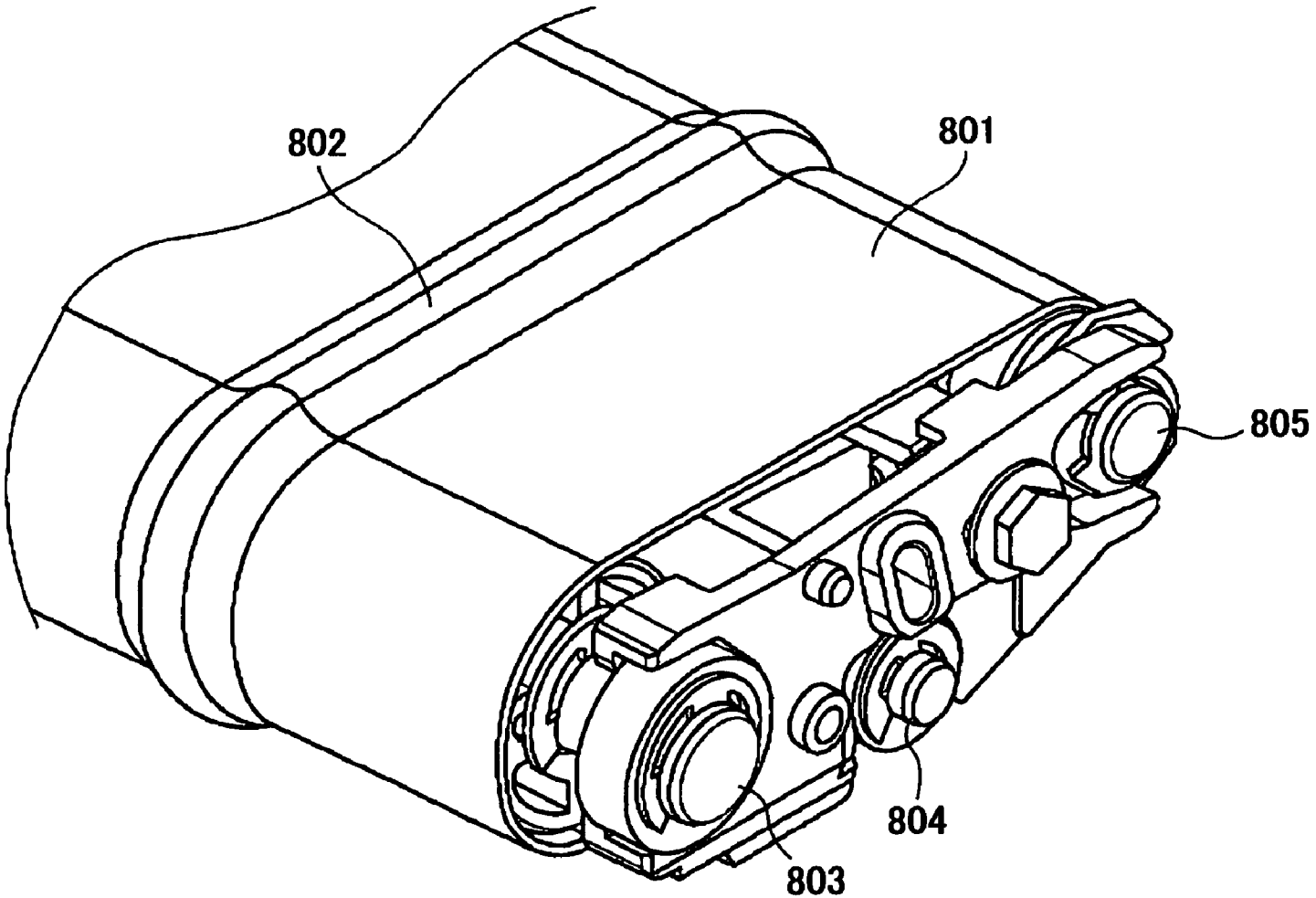
FIG. 1 is a perspective view of a conveyor belt spanned around rollers, in which a part of the conveyor belt is protruded toward its outer circumferential surface side.

Example embodiments of the present invention are described with reference to the drawings, wherein like reference numerals designate identical or corresponding parts throughout the views.

Figure 2:
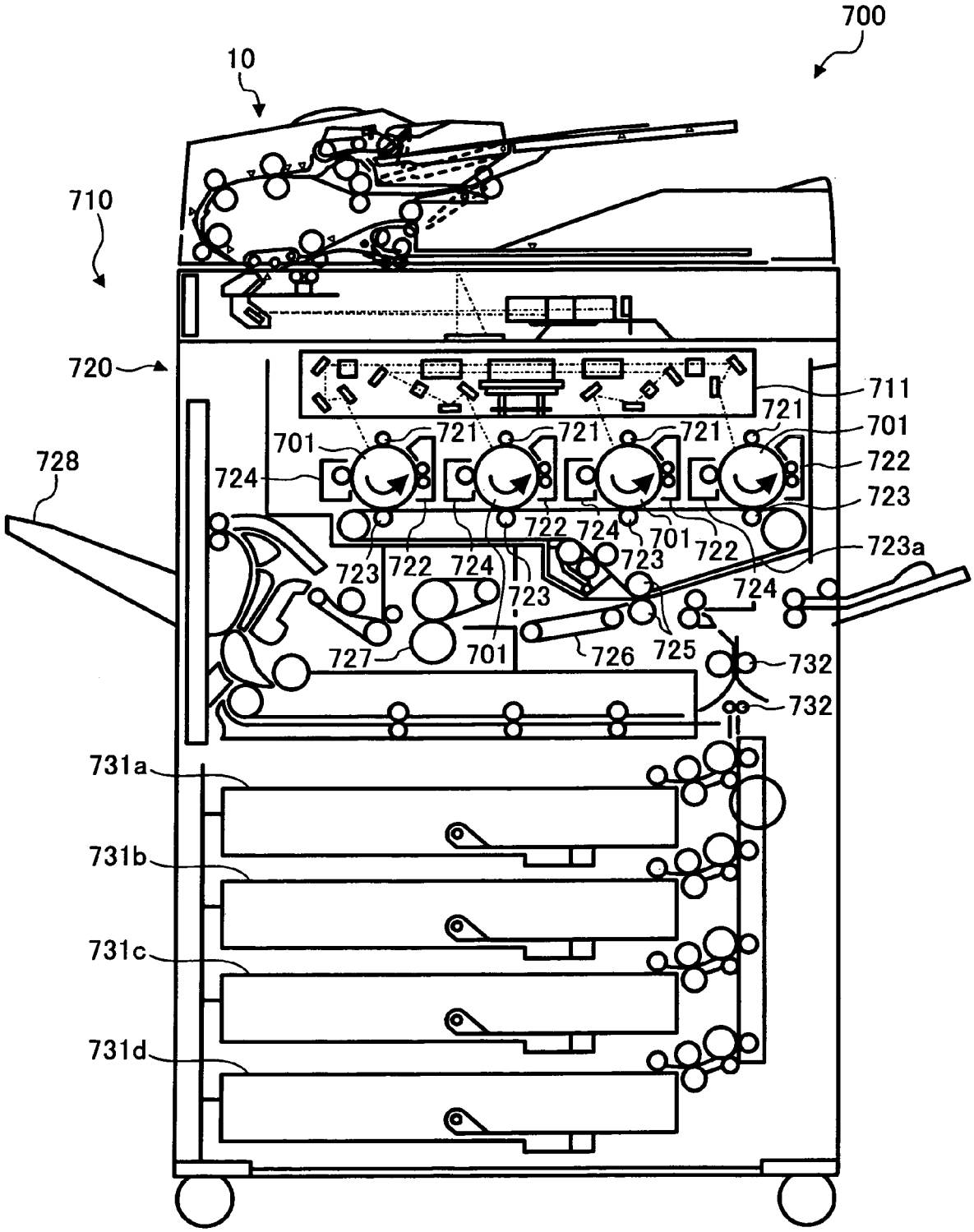
FIG. 2 is a schematic sectional view of a color image forming apparatus according to an example embodiment of the present invention.

FIG. 2 is a schematic sectional view of a color image forming apparatus according to an example embodiment of the present invention. A color image forming apparatus 700, such as a copying machine, a printer, a facsimile, or other similar image forming apparatus, includes an auto document feeder 10 acting as a sheet feeding device, a main body 710 including an image forming device 720, and a sheet feeding unit 731.

As illustrated in FIG. 2, the image forming device 720 includes the so-called tandem-type, four-image forming units that form images of different colors. Each of the image forming units includes an image carrier 701 formed from an amorphous metal, such as photoconductive amorphous silicon and amorphous selenium, and organic compounds, such as bisazo pigments, and phthalocyanine pigments. In view of environmental issues and post-processing after use, it is preferable that the image carrier 701 is formed from organic compounds. Each of the image forming units further includes a charging roller 721, a developing device 722, a primary transfer device 723, and a cleaning device 724, all of which are disposed around the image carrier 701. The image forming device 720 further includes a fixing device 727. The configuration and operation of the elements of each of the four image forming units are substantially the same except for the color of toner used therein.

In place of the charging roller 721 acting as a charging device, a corona-type charging device, a roller-type charging device, a brush-type charging device, or a blade-type charging device may be employed. A voltage is applied to a gap between the charging roller 721 and the image carrier 701, thereby generating a corona discharge between the charging roller 721 and the image carrier 701, so that the surface of the image carrier 701 is uniformly charged.

The image forming device 720 further includes an exposing device 711 that irradiates the surface of each of the image carriers 701 with laser light based on image data of an original document read by an image reading device 740 (shown in FIG. 3) and image data transmitted from an outside device such as a personal computer (not shown). Thereby, an electrostatic latent image is formed on the surface of each of the image carriers 701.

The developing device 722 develops the electrostatic latent image with toner, and forms a toner image on the surface of the image carrier 701. The toner images of different colors, which have been formed on the image carriers 701, are sequentially transferred to an intermediate transfer belt 723*a*, while being superimposed on one another by the respective primary transfer devices 723. Subsequently, a superimposed color image is transferred from the intermediate transfer belt 723*a* to a recording sheet by a secondary transfer device 725. After the toner image is transferred from the image carrier 701 to the intermediate transfer belt 723*a*, the cleaning device 724 removes residual toner remaining on the image carrier 701.

The sheet feeding unit 731 disposed below the image forming device 720, includes a plurality of sheet feeding cassettes 731*a*, 731*b*, 731*c*, and 731*d* that accommodate recording sheets therein. The recording sheet fed out from one of the sheet feeding cassettes 731*a*, 731*b*, 731*c*, and 731*d* is conveyed to the secondary transfer device 725 by sheet conveying rollers 732.

The recording sheet, to which the color image is transferred from the intermediate transfer belt 723*a*, is conveyed to the fixing device 727 by a conveyor belt 726. The color image is fixed onto the recording sheet by heat and pressure while the recording sheet passes through the fixing device 727. Subsequently, the recording sheet having a fixed color image is discharged and stacked on a sheet discharging tray 728.

Next, the configuration of the auto document feeder 10 is described with reference to FIG. 3. The auto document feeder 10 is connected to an upper portion of the main body 710 of the image forming apparatus 700 via connection members, such that the auto document feeder 10 is configured to be opened and closed with respect to the main body 710 of the image forming apparatus 700. The auto document feeder 10 includes an original document setting table 11, a pick-up roller 12, a sheet feeding belt 13, a reverse roller 14, a pair of pull-out rollers 15, a pair of turn rollers 16, a pair of reading entrance rollers 17, a pair of outlet rollers 18, a pair of sheet discharging rollers 19, a sheet discharging tray 20, a conveyor belt 30, a conveyor belt drive roller 40, a conveyor belt pressure roller 50, and a conveyor belt driven roller 60. A sheet conveying path through which an original document is conveyed is formed in the auto document feeder 10.

The main body 710 of the image forming apparatus 700 further includes the image reading device 740 at its upper portion, which reads an image of an original document fed and conveyed by the auto document feeder 10 at an image reading position 91. The main body 710 of the image forming apparatus 700 further includes a slit glass 92, an original document scale 93, and a contact glass 94 at its upper surface portion.

Next, the operation of the auto document feeder 10 is described. An uppermost original document is fed and separated from a stack of original documents 99 which have been set on the original document setting table 11, by the pick-up roller 12, the sheet feeding belt 13, and the reverse roller 14. The separated original document is conveyed to the conveyor belt 30 by the pair of pull-out rollers 15, the pair of turn rollers 16, and the pair of reading entrance rollers 17. Subsequently, the conveyor belt 30 conveys the original document to the image reading position 91 with the original document sandwiched between the conveyor belt 30 and the slit glass 92. Then, an image of the original document is read by the image reading device 740 at the image reading position 91, which is located below the slit glass 92. After the image is read, the original document is further conveyed by a pair of outlet rollers 18, and discharged and stacked on the sheet discharging tray 20 by a pair of sheet discharging rollers 19.

Figure 4:
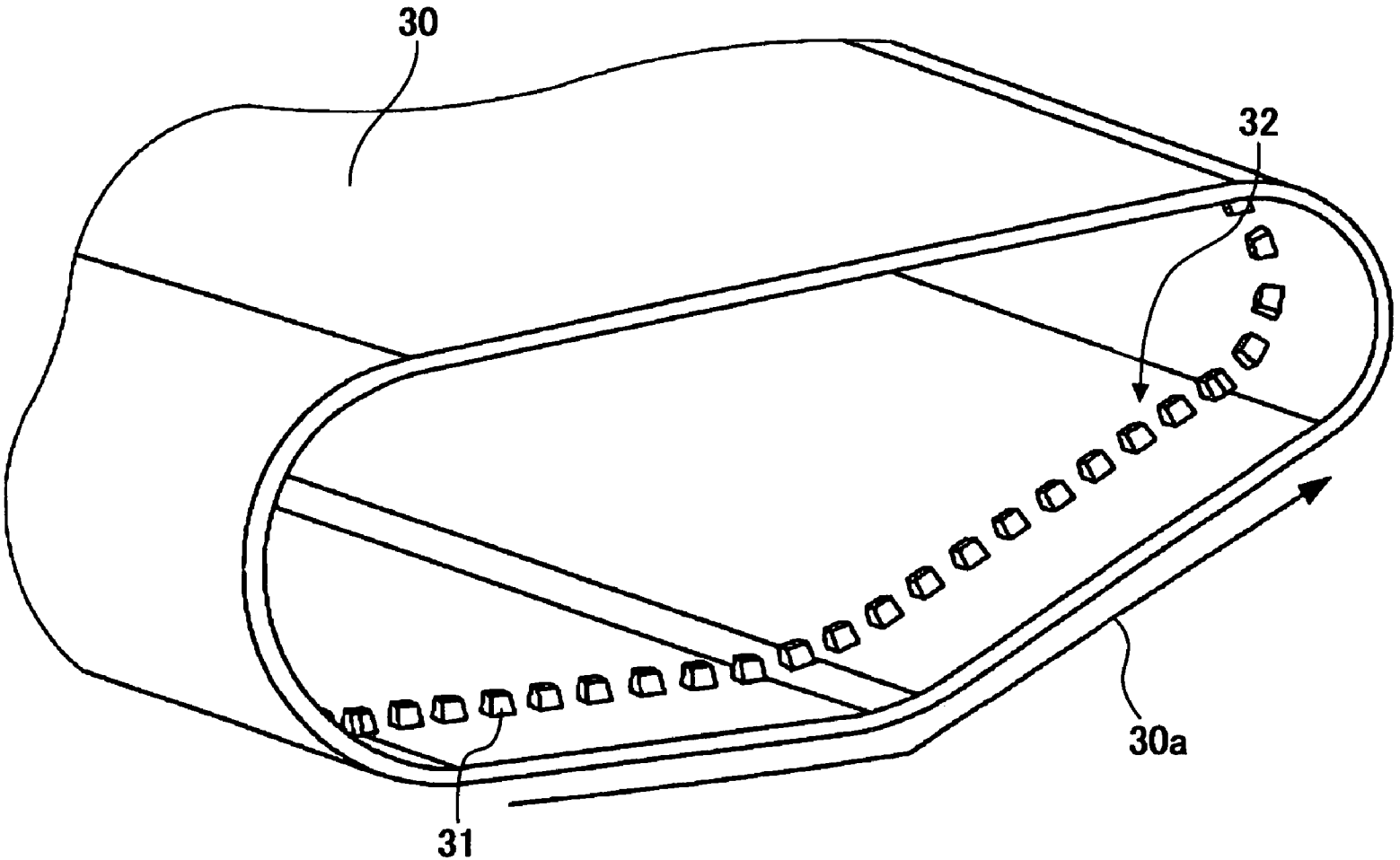
FIG. 4 is a partial perspective view of a conveyor belt used in the auto document feeder of FIG. 3.

As illustrated in FIG. 4, the conveyor belt 30 is an endless belt and is formed from a thin elastic member, such as rubber and a flexible plastic, of cylindrical shape. The conveyor belt 30 includes a row 32 of convex portions 31 intermittently arranged on its inner circumferential surface in an original document conveying direction indicated by arrow 30*a* in FIG. 4. Each of intervals between any of the two adjacent convex portions 31 is set to an appropriate value. The conveyor belt 30 may include the row 32 of the convex portions 31 at any position except for its end portions in a direction perpendicular to the original document conveying direction.

Figure 5:
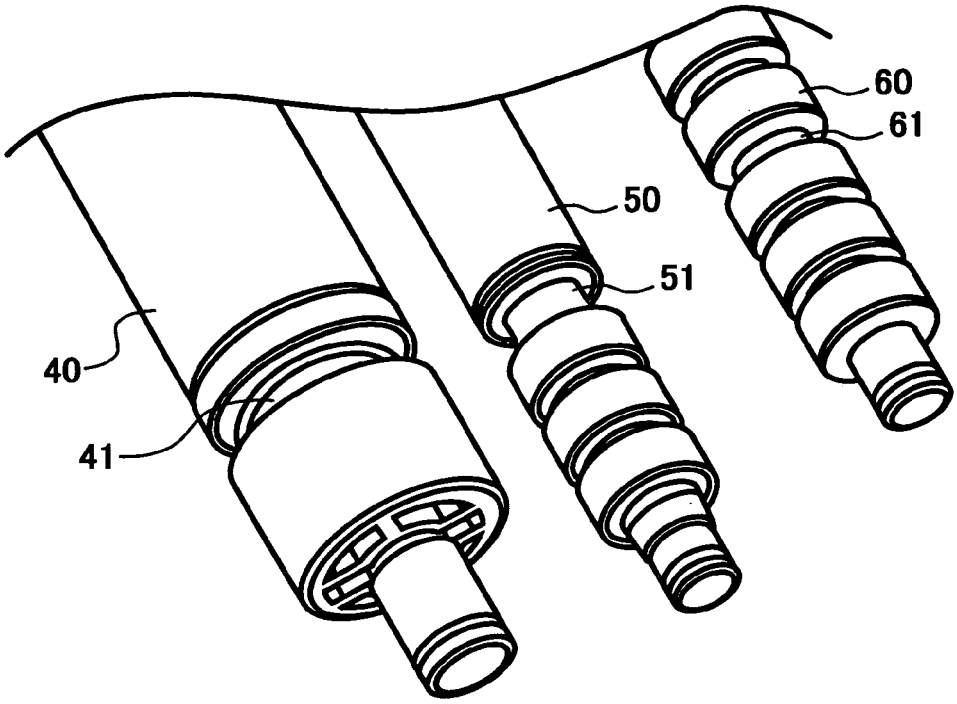
FIG. 5 is a partial perspective view of a conveyor belt drive roller, a conveyor belt pressure roller, and a conveyor belt driven roller used in the auto document feeder of FIG. 3.
Figure 6:
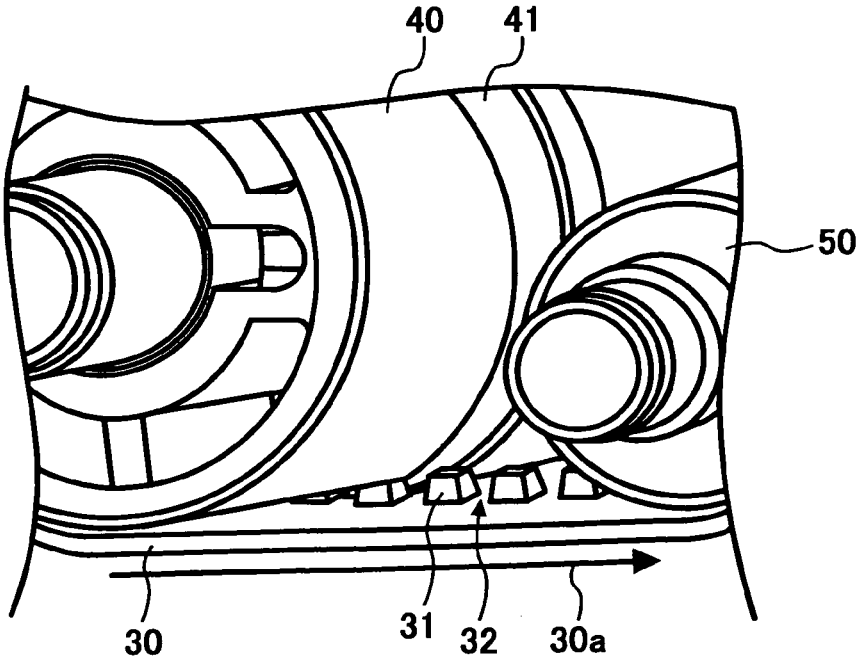
FIG. 6 is a partial enlarged perspective view of a conveyor belt, a conveyor belt drive roller, and a conveyor belt pressure roller.
Figure 7:
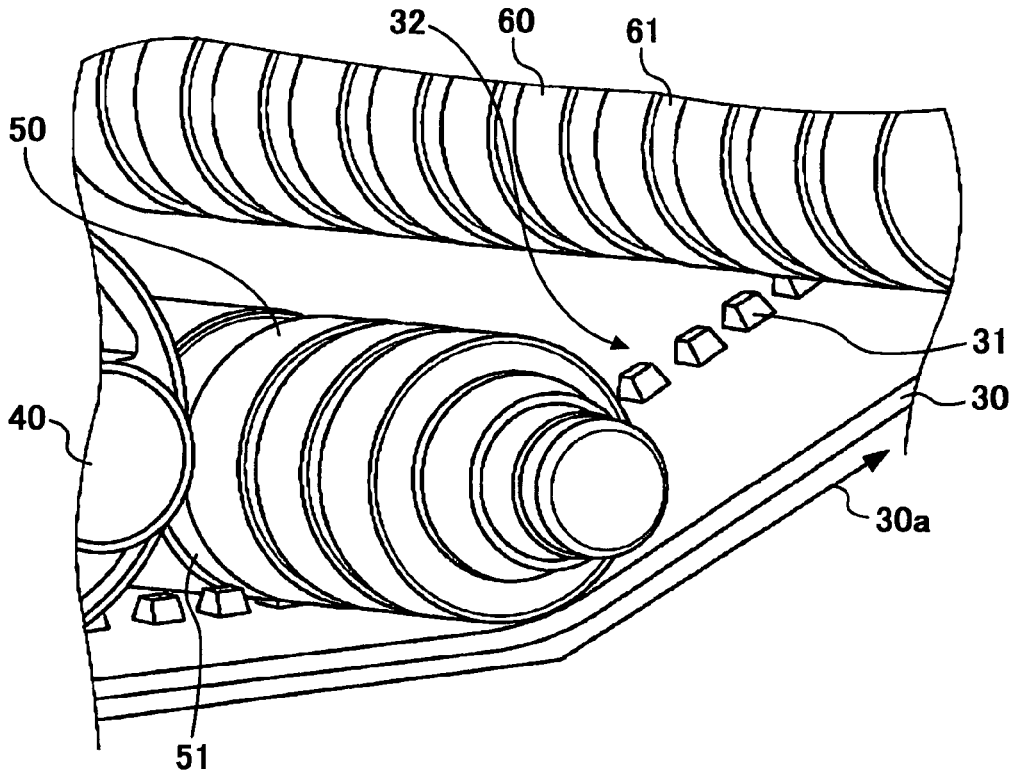
FIG. 7 is a partial enlarged perspective view of a conveyor belt, a conveyor belt drive roller, a conveyor belt pressure roller, and a conveyor belt driven roller.

As illustrated in FIG. 5, the conveyor belt drive roller 40, the conveyor belt pressure roller 50, and the conveyor belt driven roller 60 include a concave portion 41, a concave portion 51, and a concave portion 61 on their outer circumferential surfaces, respectively. As illustrated in FIGS. 6 and 7, the conveyor belt 30 is spanned around the conveyor belt drive roller 40, the conveyor belt pressure roller 50, and the conveyor belt driven roller 60, such that a direction substantially perpendicular to the original document conveying direction indicated by arrow 30*a* equals an axial direction of each of the conveyor belt drive roller 40, the conveyor belt pressure roller 50, and the conveyor belt driven roller 60. When the conveyor belt 30 is driven to rotate by the conveyor belt drive roller 40, the conveyor belt pressure roller 50 and the conveyor belt driven roller 60 are rotated in synchronization with the rotation of the conveyor belt 30. The convex portions 31 of the conveyor belt 30 engage in the concave portion 41 of the conveyor belt drive roller 40, the concave portion 51 of the conveyor belt pressure roller 50, and the concave portion 61 of the conveyor belt driven roller 60, respectively.

As illustrated in FIG. 5, a width of the concave portion 61 of the conveyor belt driven roller 60 is smaller than the respective widths of the concave portions 41 and 51. As such, the convex portions 31 are inserted in the concave portion 61 with the strongest force.

Further, as illustrated in FIGS. 6 and 7, when the conveyor belt 30 is driven to rotate by the conveyor belt drive roller 40, each of the convex portions 31 of the conveyor belt 30 is inserted in and get out from the concave portion 41 of the conveyor belt drive roller 40, the concave portion 51 of the conveyor belt pressure roller 50, and the concave portion 61 of the conveyor belt driven roller 60, sequentially.

In the auto document feeder 10 of the present embodiment, the conveyor belt 30 can be prevented from being shifted in a direction substantially perpendicular to the original document conveying direction indicated by arrow 30*a* by the engagement of each of the convex portions 31 intermittently disposed on the inner circumferential surface of the conveyor belt 30 with the concave portion 41 of the conveyor belt drive roller 40, the concave portion 51 of the conveyor belt pressure roller 50, and the concave portion 61 of the conveyor belt driven roller 60. In other words, a shift of the conveyor belt 30 in a direction along its width is regulated by engagement between the convex portions 31 and the concave portions 41, 51, and 61.

Because the conveyor belt 30 can be prevented from being shifted in a direction substantially perpendicular to the original document conveying direction, a portion of the conveyor belt 30 around the row 32 of the convex portions 31 is not lifted toward the outer circumferential surface side of the conveyor belt 30. Consequently, the flatness of the outer circumferential surface of the conveyor belt 30 can be maintained, so that the conveyor belt 30 can stably convey an original document to the image reading position 91. Therefore, an image of an original document can be read properly at the image reading position 91 by the image reading device 740, and deterioration of image quality caused by a sheet conveyance failure can be avoided.

Moreover, in the auto document feeder 10 of the present embodiment, the width of the concave portion 61 of the conveyor belt driven roller 60 is smaller than the respective widths of the concave portion 41 of the conveyor belt drive roller 40 and the concave portion 51 of the conveyor belt pressure roller 50. As such, when each of the convex portions 31 is inserted in the concave portion 41 of the conveyor belt drive roller 40 and the concave portion 51 of the conveyor belt pressure roller 50, a clearance is formed between the convex portion 31 and each of the concave portions 41 and 51. By this arrangement, when the conveyor belt 30 is attached to the rollers 40, 50, and 60, the convex portions 31 of the conveyor belt 30 can be easily inserted into the concave portions 41, 51, and 61 of the rollers 40, 50, and 60, respectively, while reducing the necessity of high accuracy for the attachment.

Further, in this embodiment, the width of the concave portion 61 of the conveyor belt driven roller 60 disposed on the most downstream side in the original document conveying direction is smaller than the respective widths of the concave portion 41 of the conveyor belt drive roller 40 and the concave portion 51 of the conveyor belt pressure roller 50. As such, the convex portions 31 can be strongly inserted in the concave portion 61. Therefore, the conveyor belt 30 can be prevented from being shifted in a direction along its width, so that a sheet conveyance failure such as a sheet skew can be prevented. Consequently, the image of an original document can be read properly by the image reading device 740 at the image reading position 91.

Figure 8:
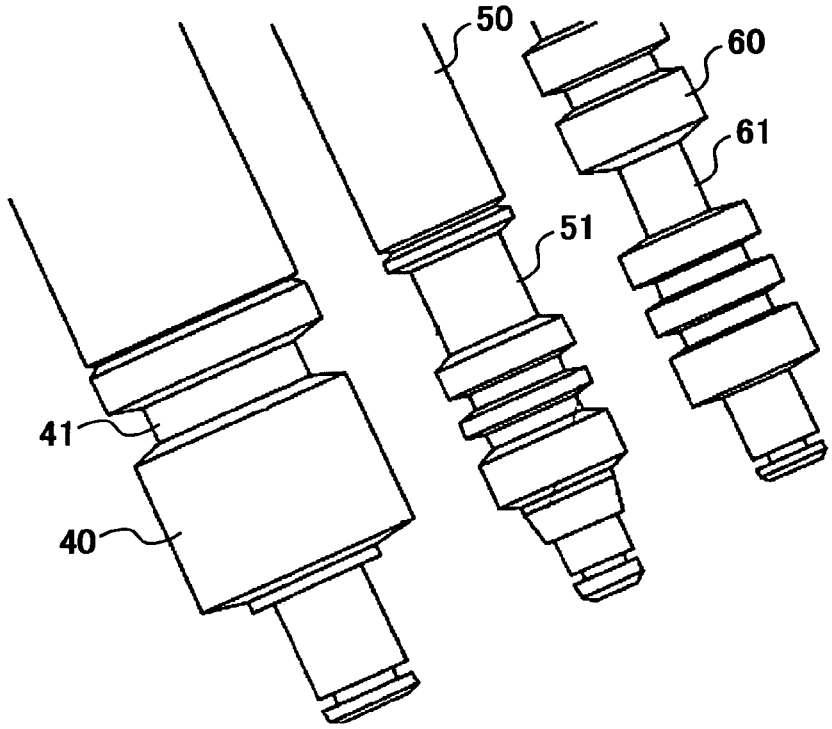
FIG. 8 is a top view of a conveyor belt drive roller, a conveyor belt pressure roller, and a conveyor belt driven roller in which a width of a concave portion of the conveyor belt drive roller is smaller than respective widths of a concave portion of the conveyor belt pressure roller and a concave portion of the conveyor belt driven roller.

Instead of setting the width of the concave portion 61 of the conveyor belt driven roller 60 smaller than the respective widths of the concave portion 41 of the conveyor belt drive roller 40 and the concave portion 51 of the conveyor belt pressure roller 50, the width of the concave portion 41 of the conveyor belt drive roller 40 disposed on the most upstream side in the original document conveying direction may be smaller than the respective widths of the concave portion 51 of the conveyor belt pressure roller 50 and the concave portion 61 of the conveyor belt driven roller 60 as illustrated in FIG. 8. As such, the convex portions 31 can be strongly inserted in the concave portion 41 of the conveyor belt drive roller 40. Therefore, the conveyor belt 30 can be prevented from being shifted in its width direction, so that a sheet conveyance failure such as a sheet skew can be prevented. Consequently, the image of an original document can be read properly by the image reading device 740 at the image reading position 91.

Figure 9:
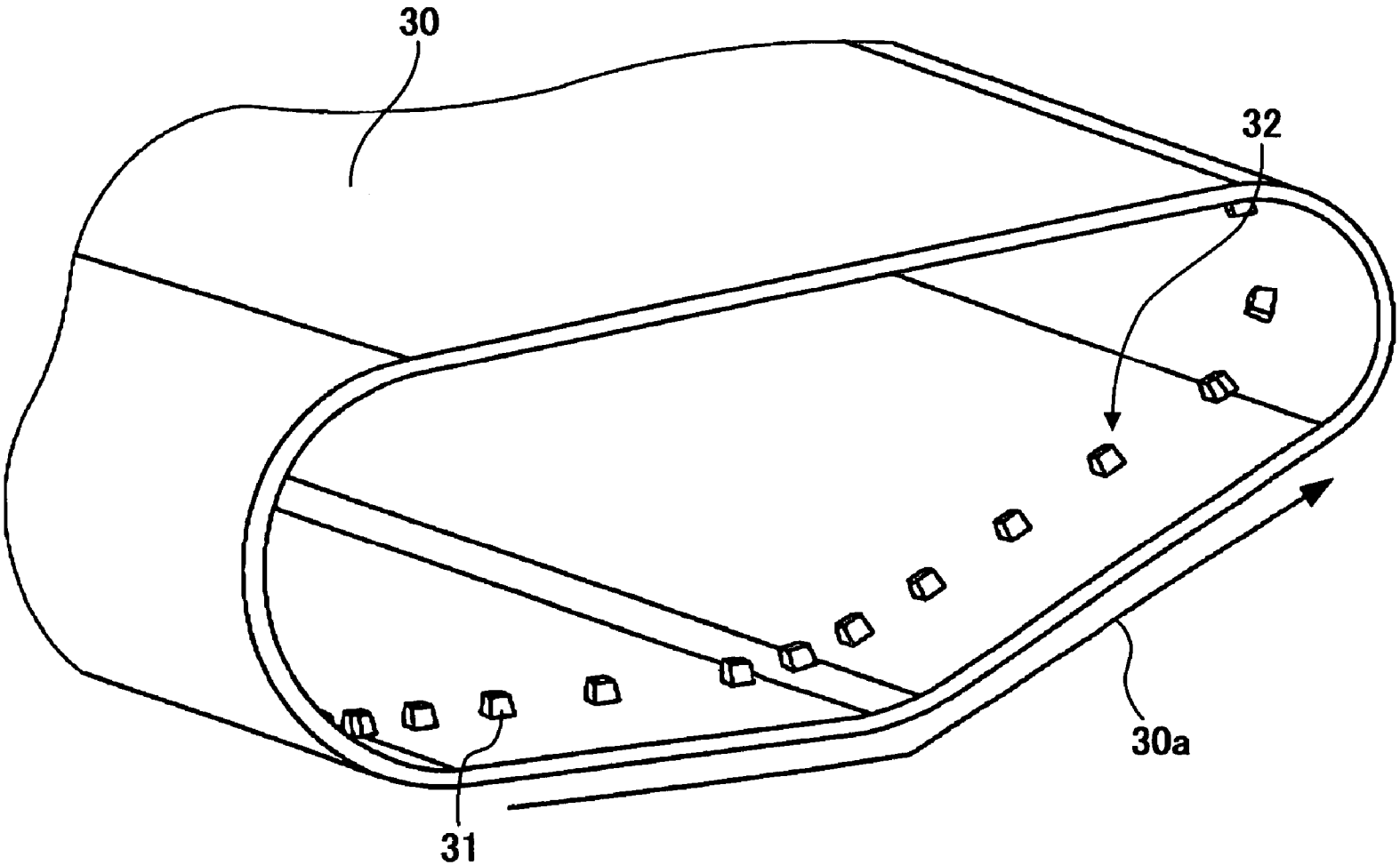
FIG. 9 is a partial perspective view of a conveyor belt in which intervals between any of two adjacent convex portions are uneven.

In the above-described embodiment, the intervals between any of the two adjacent convex portions 31 are even as illustrated in FIG. 4. However, the intervals between any of the two adjacent convex portions 31 may be uneven as illustrated in FIG. 9. If the intervals between any of the two adjacent convex portions 31 are even, the resonance frequency of the conveyor belt 30 is constant during the rotation of the conveyor belt 30, so that noise may be produced. In contrast, if the intervals between any of the two adjacent convex portions 31 are uneven, the resonance frequency of the conveyor belt 30 is not constant during the rotation of the conveyor belt 30, so that the production of noise may be minimized or avoided.

Next, a configuration of an auto document feeder according to another example embodiment of the present invention is described.

Figure 3:
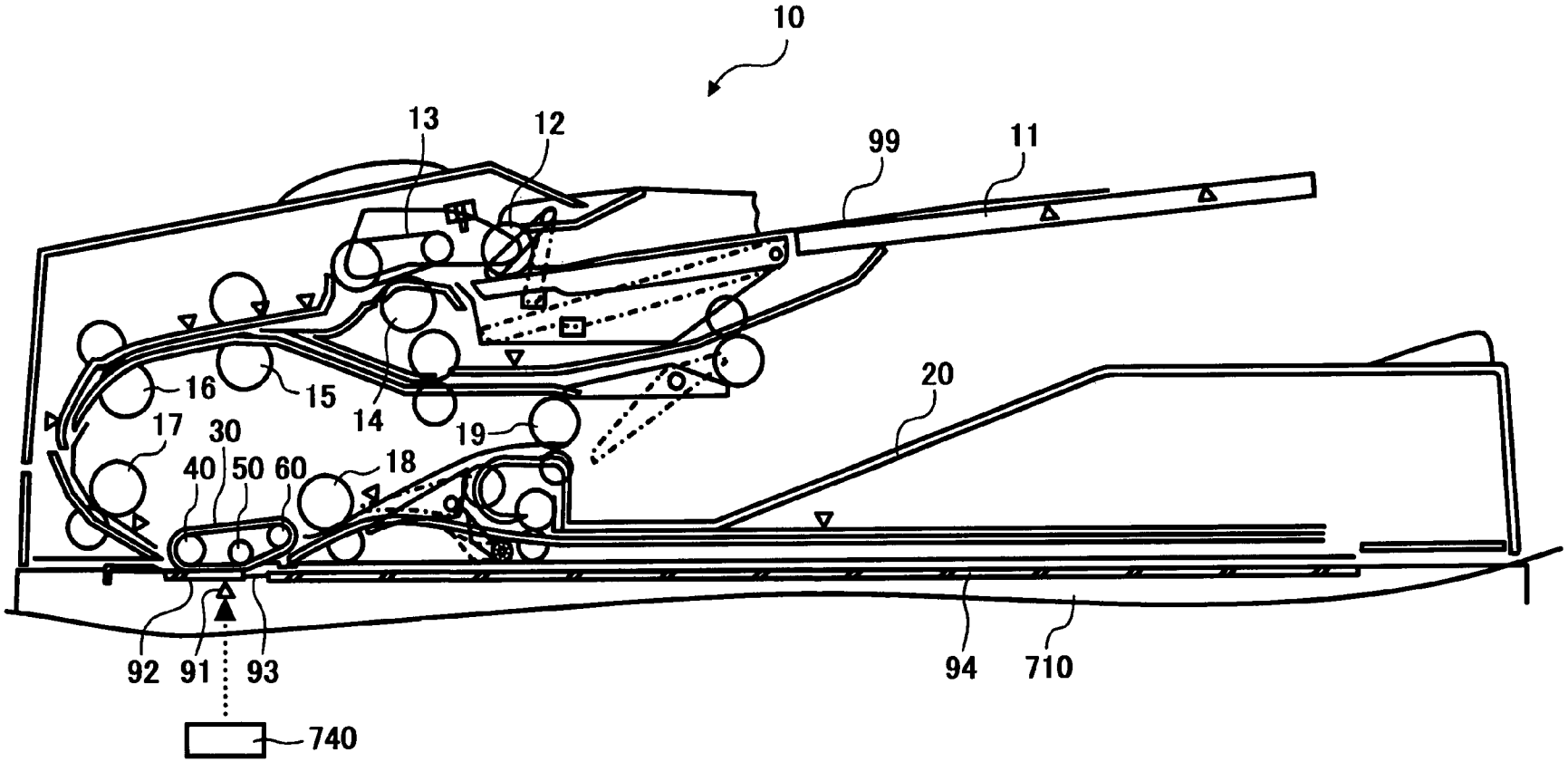
FIG. 3 is a cross section of an auto document feeder according to an example embodiment of the present invention.
Figure 11:
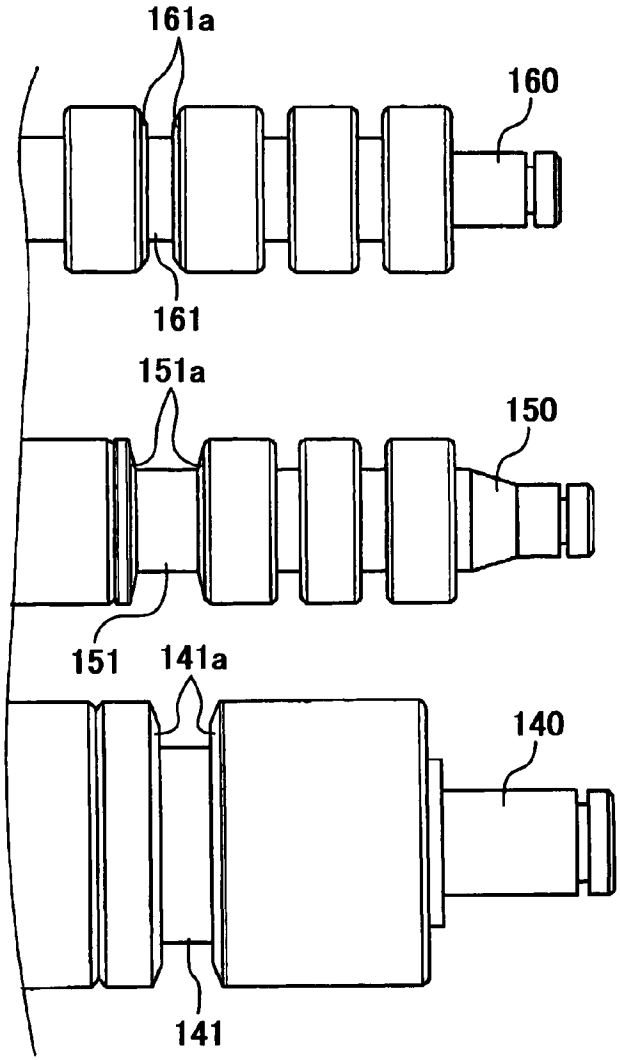
FIG. 11 is a partial top view of a conveyor belt drive roller, a conveyor belt pressure roller, and a conveyor belt driven roller according to the another example embodiment of the present invention.
Figure 10:
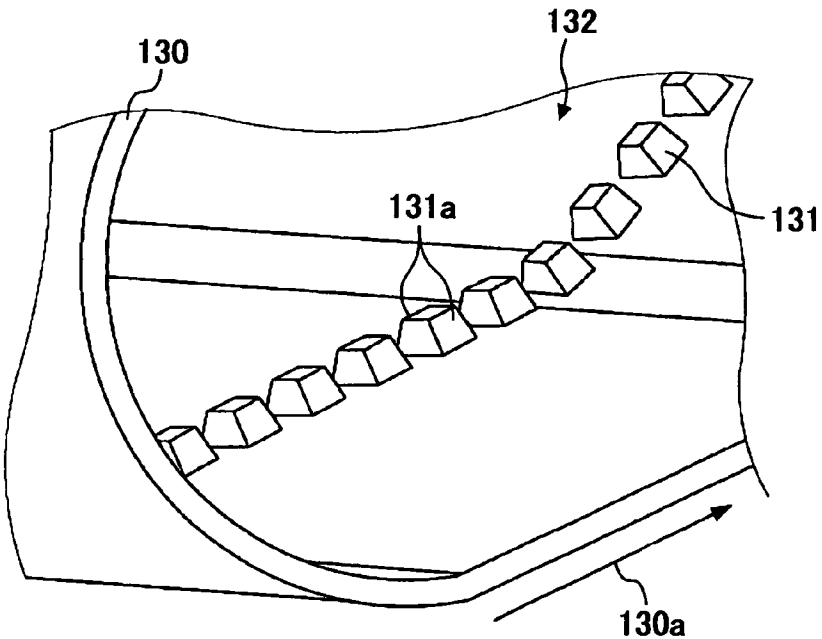
FIG. 10 is a partial perspective view of a conveyor belt used in the auto document feeder of FIG. 3 according to another example embodiment of the present invention.

The auto document feeder 10 of this embodiment includes a conveyor belt 130, a conveyor belt drive roller 140, a conveyor belt pressure roller 150, and a conveyor belt driven roller 160 illustrated in FIGS. 10 and 11, in place of the conveyor belt 30, the conveyor belt drive roller 40, the conveyor belt pressure roller 50, and the conveyor belt driven roller 60 illustrated in FIG. 3.

As illustrated in FIG. 10, the conveyor belt 130 is an endless belt formed from a thin elastic member, such as rubber and a flexible plastic, of cylindrical shape. The conveyor belt 130 conveys an original document to the image reading position 91. The conveyor belt 130 includes a row 132 of convex portions 131 intermittently arranged on its inner circumferential surface in an original document conveying direction indicated by arrow 130*a* in FIG. 10. The conveyor belt 130 may include the row 132 of the convex portions 131 at any position except for its end portions in a direction perpendicular to the original document conveying direction.

Each of the convex portions 131 of the conveyor belt 130 includes slope surfaces 131*a*. Specifically, the convex portion 131 is in a wedge shape, and the width of the convex portion 131 decreases from a bottom side toward a top side of the convex portion 131.

As illustrated in FIG. 11, the conveyor belt drive roller 140, the conveyor belt pressure roller 150, and the conveyor belt driven roller 160 include a concave portion 141, a concave portion 151, and a concave portion 161 on their outer circumferential surfaces, respectively. The concave portion 141, the concave portion 151, and the concave portion 161 include slope surfaces 141*a*, slope surfaces 151*a*, and slope surfaces 161*a*, respectively.

Figure 12:
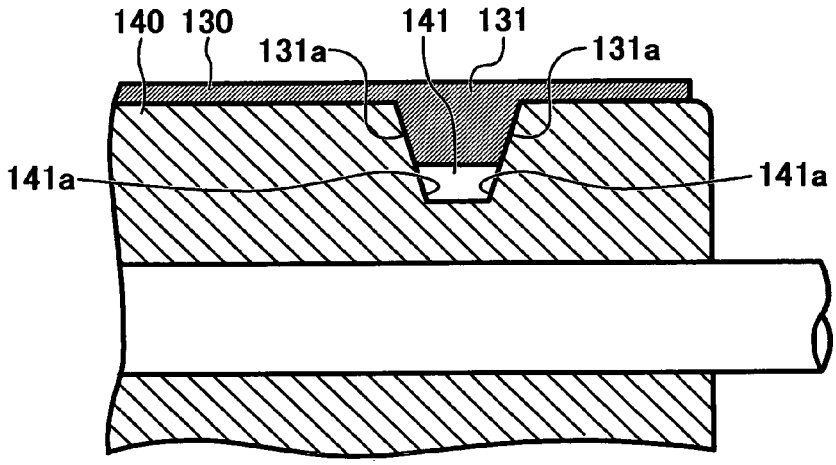
FIG. 12 is a cross section of the conveyor belt of FIG. 10 and the conveyor belt drive roller of FIG. 11.

Similarly, to the auto document feeder 10 of FIG. 3, the conveyor belt 130 is spanned around the conveyor belt drive roller 140, the conveyor belt pressure roller 150, and the conveyor belt driven roller 160, such that the direction substantially perpendicular to the original document conveying direction indicated by arrow 130*a* equals an axial direction of each of the conveyor belt drive roller 140, the conveyor belt pressure roller 150, and the conveyor belt driven roller 160. When the conveyor belt 130 is driven to rotate by the conveyor belt drive roller 140, the conveyor belt pressure roller 150 and the conveyor belt driven roller 160 are rotated in synchronization with the rotation of the conveyor belt 130. As illustrated in FIG. 12, the convex portions 131 of the conveyor belt 130 engage in the concave portion 141 of the conveyor belt drive roller 140. Likewise, the convex portions 131 of the conveyor belt 130 engage in the concave portion 151 of the conveyor belt pressure roller 150, and the concave portion 161 of the conveyor belt driven roller 160, respectively.

Further, as illustrated in FIG. 11, a width of the concave portion 161 of the conveyor belt driven roller 160 is smaller than the respective widths of the concave portion 141 of the conveyor belt drive roller 140 and the concave portion 151 of the conveyor belt pressure roller 150. As such, the convex portions 131 engage in the concave portion 161 with the strongest force.

As described above, in the auto document feeder of the present embodiment, the width of the convex portion 131 of the conveyor belt 130 decreases from a bottom side toward a top side thereof, and the concave portion 141, the concave portion 151, and the concave portion 161 include slope surfaces 141*a*, slope surfaces 151*a*, and slope surfaces 161*a*, respectively. With this configuration, abrasion of the convex portions 131 of the conveyor belt 130 caused by friction between the convex portions 131 and each of the concave portion 141, the concave portion 151, and the concave portion 161, can be lessened. As a result, the period in which the convex portions 131 prevents the conveyor belt 130 from shifting in a direction substantially perpendicular to the original document conveying direction can be extended.

Further, in the auto document feeder of the present embodiment, because the abrasion of the convex portions 131 of the conveyor belt 130 can be lessened, the production of abrasion powders of the convex portions 131 can be decreased, so that abrasion powders of the convex portions 131 can be minimized or prevented from being scattered and stacked on the slit glass 92 and the contact glass 94 of the main body 710 of the image forming apparatus 700. Thus, occurrences of spot and streak in an image of an original document read by the image reading device 740, which is caused by abrasion powders on the slit glass 92 and the contact glass 94, can be minimized or prevented.

Moreover, the convex portions 131 of the conveyor belt 130 and the respective concave portions 141, 151, and 161 of the conveyor belt drive roller 140, the conveyor belt pressure roller 150, and the conveyor belt driven roller 160 of the present embodiment exhibit similar effects to those of the convex portions 31 of the conveyor belt 30 and the respective concave portions 41, 51, and 61 of the conveyor belt drive roller 40, the conveyor belt pressure roller 50, and the conveyor belt driven roller 60 illustrated in FIGS. 4 and 5.

As described above, the convex portions 131 of the conveyor belt 130 are frequently inserted in and removed from the concave portion 141 of the conveyor belt drive roller 140, the concave portion 151 of the conveyor belt pressure roller 150, and the concave portion 161 of the conveyor belt driven roller 160 during rotation of the conveyor belt 130. If the surfaces of the concave portions 141, 151, and 161 are made of a material having a coarse surface, the convex portions 131 typically abrade with time, so that the shift of the conveyor belt 130 cannot be prevented by the engagement of the convex portions 131 with the concave portions 141, 151, and 161 of the rollers. Further, abrasion powders tend to be produced due to the contact of the convex portions 131 and the concave portions 141, 151, and 161.

For these reasons, as a non-limiting example, at least each surface of the concave portion 141 of the conveyor belt drive roller 140, the concave portion 151 of the conveyor belt pressure roller 150, and the concave portion 161 of the conveyor belt driven roller 160 is preferably made of a material having a smooth surface. Alternatively, entire surfaces of the conveyor belt drive roller 140, the conveyor belt pressure roller 150, and the conveyor belt driven roller 160 except for their shafts may be made of a material having a smooth surface.

Examples of the material having a smooth surface include, but not limited to, fluororesin, polyethylene resin, polyacetal resin, polyamide resin, polytetrafluoroethylene resin, polyphenylene sulfide resin, polyester resin, polyurethane resin, polyolefin resin, phenol resin, and polyimide resin. Alternatively, at least each surface of the concave portion 141 of the conveyor belt drive roller 140, the concave portion 151 of the conveyor belt pressure roller 150, and the concave portion 161 of the conveyor belt driven roller 160 may be smoothed by grinding.

Figure 13:
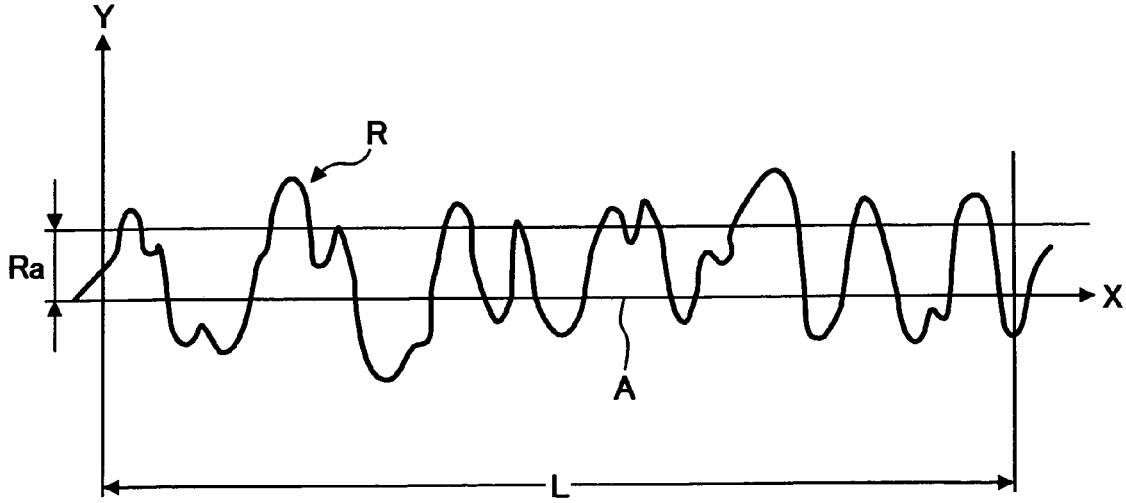
FIG. 13 is a graph illustrating an arithmetic average roughness (Ra)

It is preferable that an outer circumferential surface of each of the rollers 140, 150, and 160 has an arithmetic average roughness (Ra) of about 10 μm or less, and a surface of the concave portion of each of the rollers 140, 150, and 160 has an arithmetic average roughness (Ra) of about 5 μm or less. With reference to FIG. 13, when taking an X-axis in the direction of an average line A of a roughness curve "R" sampled by a standard length "L", taking a Y-axis in the direction perpendicular to the X-axis, and expressing the roughness curve "R" by a function y=f(X), the arithmetic average roughness (Ra) represents a value (μm) obtained by the following formula, $$Ra = 1/L\int_0^L |f(x)|\,dx \tag{1}$$

The standard length "L" and the average roughness are determined according to JIS B0601.

As described above, the conveyor belt 130 can be prevented from being shifted in a direction substantially perpendicular to the original document conveying direction indicated by arrow 130*a* by the engagement of each of the convex portions 131 with the concave portion 141 of the conveyor belt drive roller 140, the concave portion 151 of the conveyor belt pressure roller 150, and the concave portion 161 of the conveyor belt driven roller 160. Further, because at least each surface of the concave portion 141 of the conveyor belt drive roller 140, the concave portion 151 of the conveyor belt pressure roller 150, and the concave portion 161 of the conveyor belt driven roller 160 is made of a material having a smooth surface, abrasion of the convex portions 131 can be minimized or avoided, thereby preventing the shift of the conveyor belt 130 in a direction substantially perpendicular to the original document conveying direction. Moreover, because the abrasion of the convex portions 131 of the conveyor belt 130 can be minimized or avoided, the production of abrasion powders of the convex portions 131 of the conveyor belt 130 can be lessened, so that abrasion powders of the convex portions 131 can be prevented from being scattered and stacked on the slit glass 92 and the contact glass 94 of the main body 710 of the image forming apparatus 700. Thus, occurrences of spot and streak in the image of an original document read by the image reading device 740, which are caused by abrasion powders on the slit glass 92 and the contact glass 94, can be prevented.

Alternatively, the abrasion of the convex portions 131 of the conveyor belt 130 can be prevented by setting a coefficient of friction of the surface of the concave portion of each of the rollers 140, 150, and 160 to be less than coefficient of friction of the outer circumferential surface of each of the rollers 140, 150, and 160.

Figure 14:
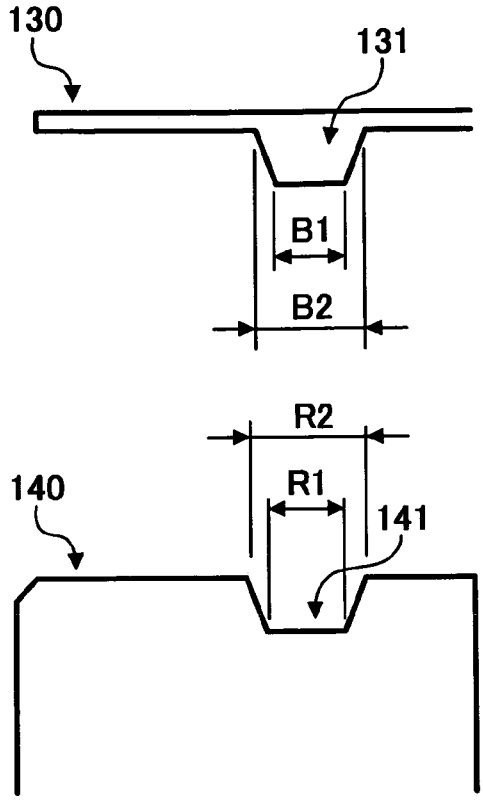
FIG. 14 is a cross section of a convex portion of the conveyor belt and a concave portion of the conveyor belt drive roller illustrating a relationship between a width of the convex portion and a width of the concave portion.

FIG. 14 is a cross section of the convex portion 131 of the conveyor belt 130 and the concave portion 141 of the conveyor belt drive roller 140 according to another example embodiment. In FIG. 14, a width of the top portion of the convex portion 131 is indicated by a reference character "B1", a width of the bottom portion of the convex portion 131 is indicated by a reference character "B2", a width of the bottom portion of the concave portion 141 is indicated by a reference character "R1", and a width of the top portion of the concave portion 141 is indicated by a reference character "R2".

The convex portion 131 and the concave portion 141 satisfy following relationships, $$R1=B1+\alpha \tag{2}$$

$$R2=B2+\alpha \tag{3}$$

Figure 15:
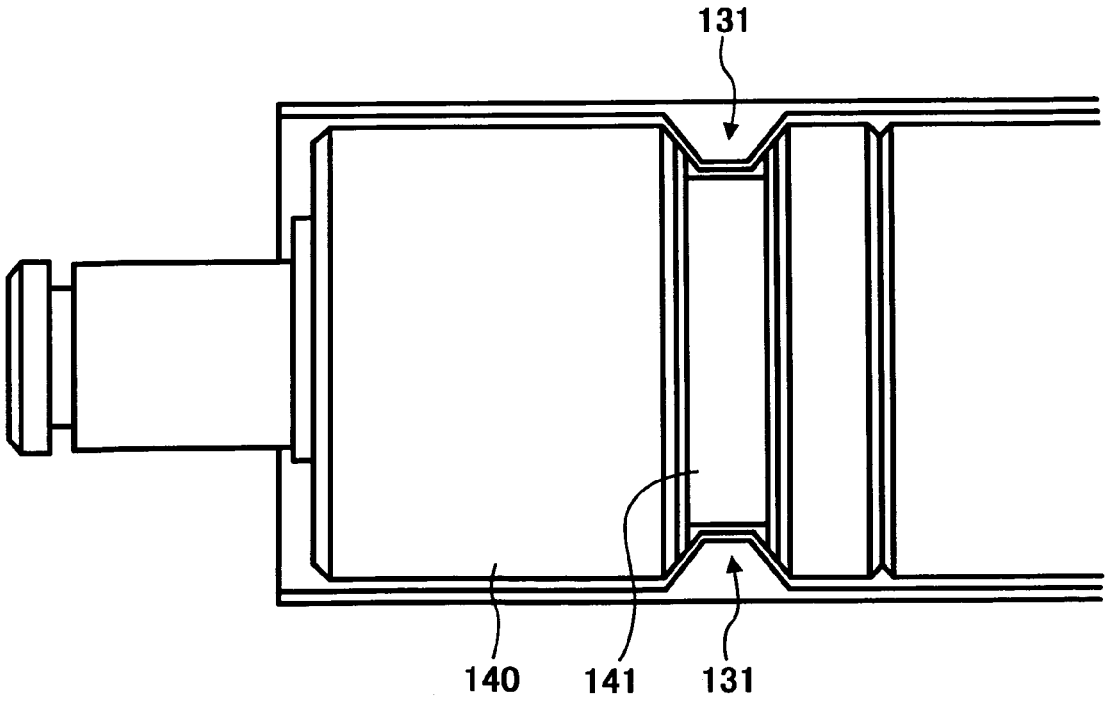
FIG. 15 is a diagram showing a state when the convex portions are engaged with the concave portion, satisfying the relationship illustrated in FIG. 14.

In the relationships (2) and (3), "α" is an infinitesimal value. For example, "α" is in a range of about a tenth to a hundredth part of the width B1 or B2. Specifically, the width of the convex portion 131 and the width of the concave portion 141 may be substantially equal. Alternatively, the width of the concave portion 141 may be greater than the width of the convex portion 131 by the infinitesimal value "α". As such, the convex portions 131 of the conveyor belt 130 can be inserted in the concave portion 141 of the conveyor belt drive roller 140 strongly, so that the conveyor belt 130 can be prevented from being shifted in the direction substantially perpendicular to the original document conveying direction. FIG. 15 shows a state when the convex portions 131 are engaged in the concave portion 141, satisfying the relationships (2) and (3).

Figure 16:
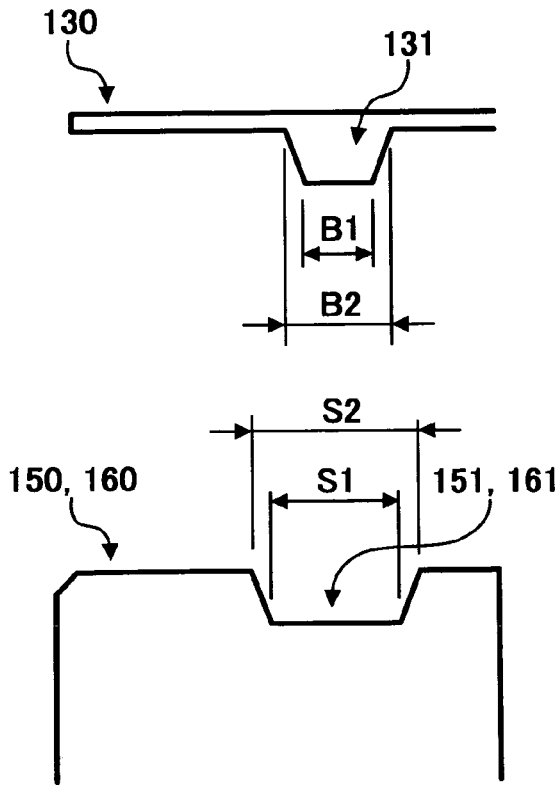
FIG. 16 is a cross section of a convex portion of a conveyor belt and a concave portion of a conveyor belt pressure roller or a conveyor belt driven roller illustrating a relationship between a width of the convex portion and a width of the concave portion.

FIG. 16 is a cross section of the convex portion 131 of the conveyor belt 130 and the concave portion 151 of the conveyor belt pressure roller 150 or the concave portion 161 of the conveyor belt driven roller 160 according to another embodiment. In FIG. 16, the width of the top portion of the convex portion 131 is indicated by the reference character B1, the width of the bottom portion of the convex portion 131 is indicated by the reference character B2, a width of the bottom portion of the concave portion 151 or 161 is indicated by a reference character S1, and a width of the top portion of the concave portion 151 or 161 is indicated by a reference character S2.

The convex portion 131 and the concave portion 151 or 161 satisfy the following relationships, $$S1=B1+\beta \tag{4}$$

$$S2=B2+\beta \tag{5}$$

Figure 17:
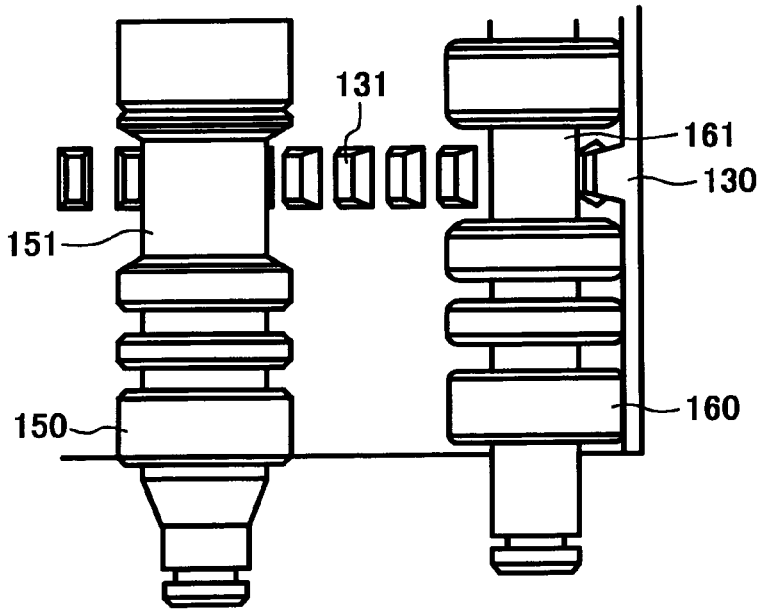
FIG. 17 is a diagram showing a state when the convex portions are engaged in the concave portions, satisfying the relationship explained in FIG. 16.

In the relationships (4) and (5), "β" is a value which is about 0.5 times, one time, or two times of the width B1, for example. Specifically, the width of the concave portion 151 or 161 is sufficiently great relative to the width of the convex portion 131. Thus, a sufficient clearance is formed between the convex portion 131 and the concave portion 151 or 161 when the convex portion 131 engages in the concave portion 151 or 161. Owing to the sufficient clearance, the convex portion 131 can have flexibility when engaging in the concave portion 151 or 161. The above-described relationships (4) and (5) may be also applied to both the concave portions 151 and 161. FIG. 17 shows a state when the convex portions 131 are engaged in the concave portions 151 and 161, satisfying the relationships (4) and (5).

In the above-described relationships (2)-(5), the width of the concave portion 141 of the conveyor belt drive roller 140 is substantially equal to the width of the convex portion 131 of the conveyor belt 130, and the width of each of the concave portion 151 of the conveyor belt pressure roller 150 and the concave portion 161 of the conveyor belt driven roller 160 is sufficiently great relative to the width of the convex portion 131. As such, even if the respective concave portions of the conveyor belt drive roller 140, the conveyor belt pressure roller 150, and the conveyor belt driven roller 160 are not placed in proper alignment, the convex portions 131 of the conveyor belt 130 can be surely inserted in the concave portions 141, 151, and 161. Consequently, the conveyor belt 130 can be smoothly rotated, thereby stably conveying an original document to the image reading position 91. If the width of each of the concave portions 141, 151, and 161 is set to be substantially equal to the width of the convex portion 131 and if the concave portions 141, 151, and 161 are not placed in proper alignment, the convex portions 131 cannot be easily and adequately inserted in the concave portions 141, 151, and 161. Consequently, for example, one side of the convex portion 131 may strongly abut against the slope surface of the concave portion during the rotation of the conveyor belt 130, resulting in abrasion of the convex portion 131. Further, one side of the convex portion 131 may not be properly inserted in the concave portion, and may be lifted and go on the outer circumferential surfaces of the rollers as the conveyor belt 130 rotates. If the conveyor belt 131 is rotated in this condition, a load on a drive device (not shown) increases. If the convex portions 131 engage in the concave portions of the rollers too tightly, a load on the drive device may increase as well, and the convex portion 131 may be abraded due to the friction between the convex portion 131 and the concave portions. However, in this embodiment, the above-described disadvantages can be minimized or overcome by causing the convex portion 131 and the concave portions 141, 151, and 161 of the rollers to satisfy the relationships (2)-(5).

Figure 18:
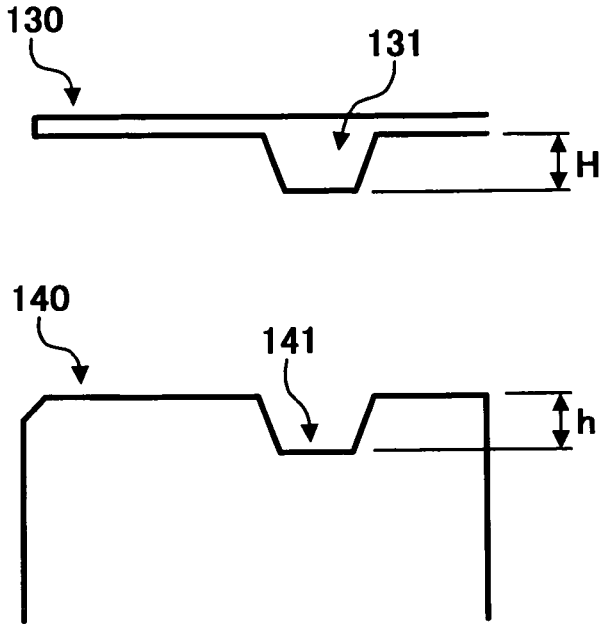
FIG. 18 is a cross section of a convex portion of a conveyor belt and a concave portion of a conveyor belt drive roller illustrating a relationship between a height of the convex portion and a depth of the concave portion.

FIG. 18 is a cross section of the convex portion 131 of the conveyor belt 130 and the concave portion 141 of the conveyor belt drive roller 140 according to another example embodiment. In FIG. 18, a height of the convex portion 131 measured from the inner circumferential surface of the conveyor belt 130 is indicated by a reference character "H", and a depth of the concave portion 141 measured from the outer circumferential surface of the conveyor belt drive roller 140 is indicated by a reference character "h".

The convex portion 131 and the concave portion 141 satisfy a following relationship, $$H<h \tag{6}$$

Specifically, the height "H" of the convex portion 131 is set to be smaller than the depth "h" of the concave portion 141. A gap is formed between the top surface of the convex portion 131 and the bottom surface of the concave portion 141 when the convex portion 131 engages in the concave portion 141. By this arrangement, deformation and abrasion of the convex portion 131 of the conveyor belt 130, which are caused by the contact of the top surface of the convex portion 131 with the bottom surface of the concave portion 141, can be prevented. Although FIG. 18 illustrates only the conveyor belt drive roller 140 as a non-limiting example, the above-described relationship (6) can be applied to the concave portion 151 of the conveyor belt pressure roller 150 and the concave portion 161 of the conveyor belt driven roller 160.

In the above-described embodiment, an impact caused by the abutment of the convex portion 131 of the conveyor belt 130 against the bottom surface of the concave portion 141 of the conveyor belt drive roller 140 (or the concave portion 151 of the conveyor belt pressure roller 150 or the concave portion 161 of the conveyor belt driven roller 160) can be minimized or avoided. Therefore, a vibration of the conveyor belt 130 due to the impact can be minimized or avoided. Thus, an original document can be prevented from vibrating and from being conveyed improperly during a period when the original document is conveyed by the conveyor belt 130 for image reading. As a result, deterioration of image quality, such as an occurrence of jitter, can be prevented.

Next, a configuration of an auto document feeder according to another example embodiment is described. The auto document feeder 10 of this embodiment includes a conveyor belt 230, a conveyor belt drive roller 240, a conveyor belt pressure roller 250, and a conveyor belt driven roller 260 illustrated in FIGS. 19 through 22, in place of the conveyor belt 30, the conveyor belt drive roller 40, the conveyor belt pressure roller 50, and the conveyor belt driven roller 60 illustrated in FIG. 3.

Figure 19:
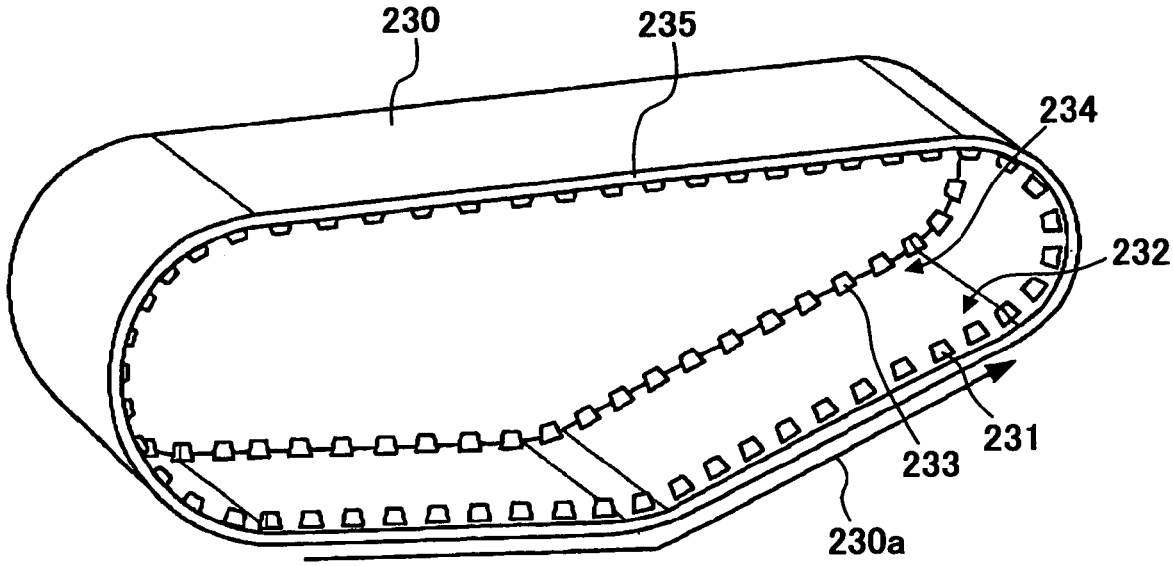
FIG. 19 is a perspective view of a conveyor belt according to another example embodiment of the present invention.
Figure 20:
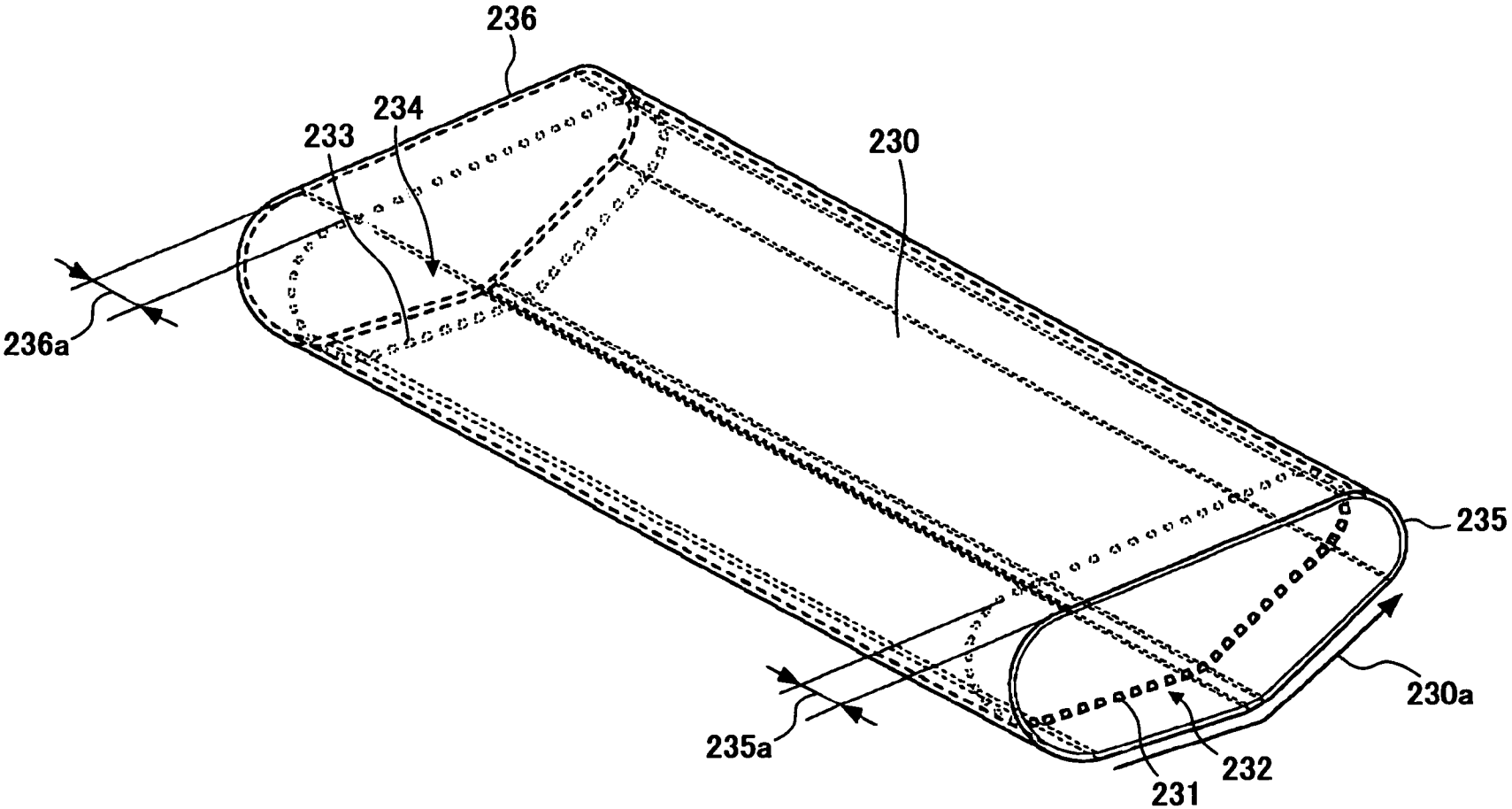
FIG. 20 is a perspective view of the conveyor belt of FIG. 19.

As illustrated in FIG. 19, the conveyor belt 230 is an endless belt and is formed from a thin elastic member, such as rubber and a flexible plastic, of cylindrical shape. The conveyor belt 230 includes a row 232 of convex portions 231 intermittently arranged on its inner circumferential surface in an original document conveying direction indicated by arrow 230*a* in FIG. 19. Further, the conveyor belt 230 includes a row 234 of convex portions 233 intermittently arranged on its inner circumferential surface in the original document conveying direction. As illustrated in FIG. 20, the conveyor belt 230 includes the row 232 of the convex portions 231 at a position inward from an end portion 235 of the conveyor belt 230 by a distance 235*a* in the direction perpendicular to the original document conveying direction indicated by arrow 230*a*. Further, the conveyor belt 230 includes the row 234 of the convex portions 233 at a position inward from an end portion 236 of the conveyor belt 230 by a distance 236*a* in the direction perpendicular to the original document conveying direction.

Figure 21:
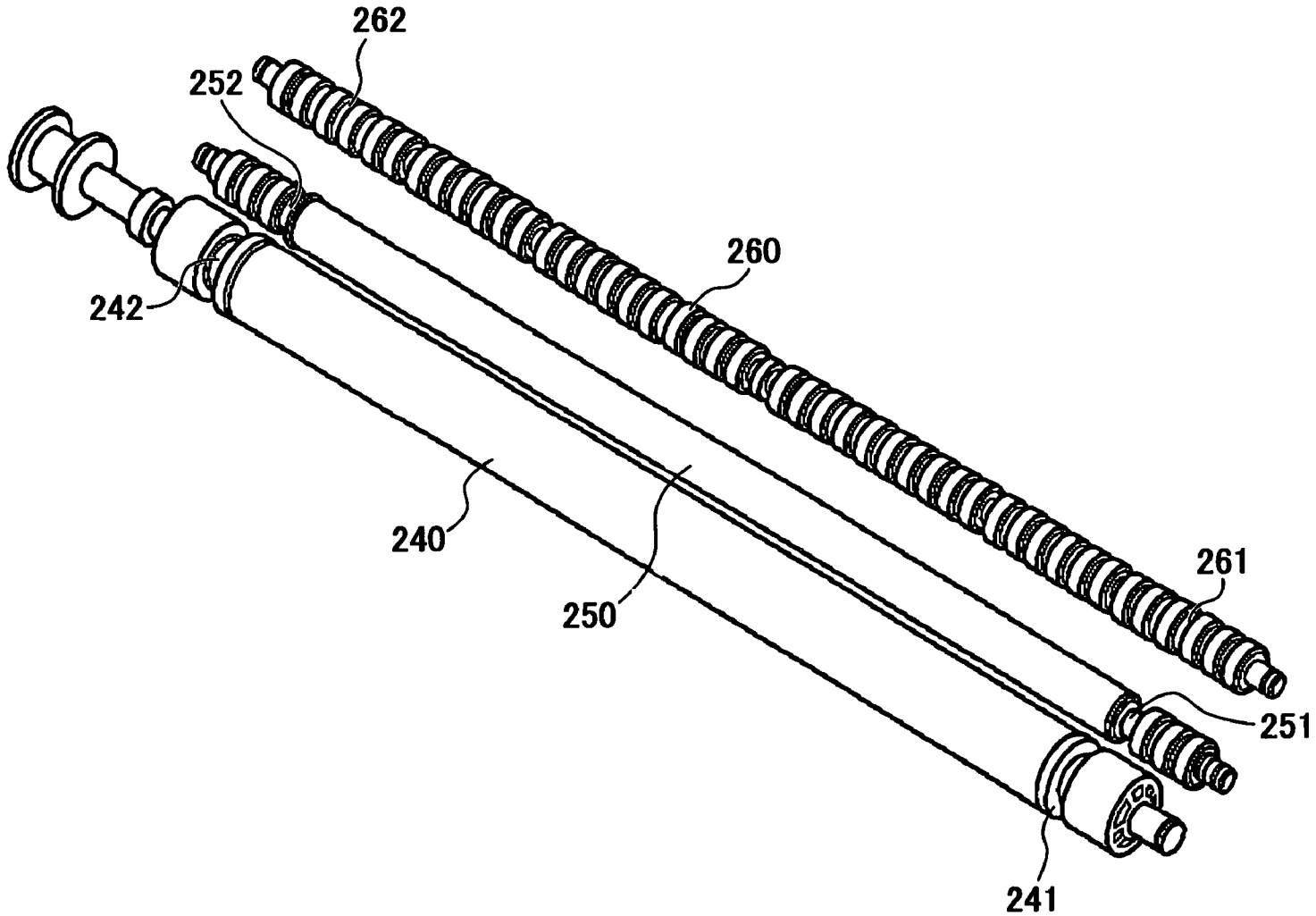
FIG. 21 is a perspective view of a conveyor belt drive roller, a conveyor belt pressure roller, and a conveyor belt driven roller according to yet another example embodiment of the present invention.

As illustrated in FIG. 21, the conveyor belt drive roller 240 includes concave portions 241 and 242 on its outer circumferential surface. The conveyor belt pressure roller 250 includes concave portions 251 and 252 on its outer circumferential surface. The conveyor belt driven roller 260 includes concave portions 261 and 262 on its outer circumferential surface.

Figure 22:
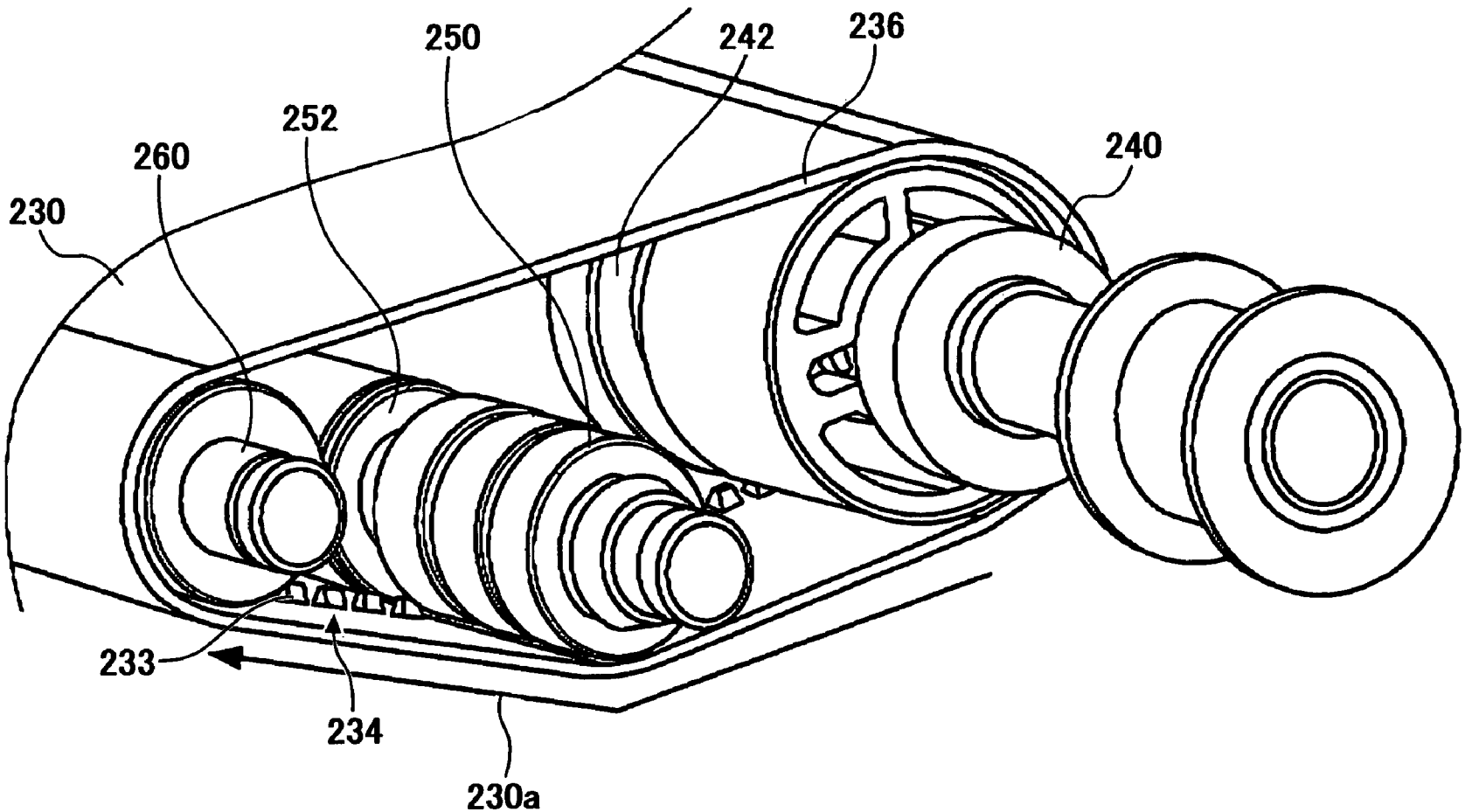
FIG. 22 is a partial perspective view of a conveyor belt, a conveyor belt drive roller, a conveyor belt pressure roller, and a conveyor belt driven roller according to yet another example embodiment of the present invention.

Similarly to the auto document feeder 10 of FIG. 3, the conveyor belt 230 is spanned around the conveyor belt drive roller 240, the conveyor belt pressure roller 250, and the conveyor belt driven roller 260 such that a direction substantially perpendicular to the original document conveying direction indicated by arrow 230*a* equals an axial direction of each of the conveyor belt drive roller 240, the conveyor belt pressure roller 250, and the conveyor belt driven roller 260. When the conveyor belt 230 is driven to rotate by the conveyor belt drive roller 240, the conveyor belt pressure roller 250 and the conveyor belt driven roller 260 are rotated in synchronization with the rotation of the conveyor belt 230. As illustrated in FIG. 22, the convex portions 233 of the conveyor belt 230 engage in the concave portion 242 of the conveyor belt drive roller 240, the concave portion 252 of the conveyor belt pressure roller 250, and the concave portion 262 of the conveyor belt driven roller 260, respectively. Likewise, the convex portions 231 of the conveyor belt 230 engage in the concave portion 241 of the conveyor belt drive roller 240, the concave portion 251 of the conveyor belt pressure roller 250, and the concave portion 261 of the conveyor belt driven roller 260, respectively.

In the auto document feeder 10 of the present embodiment, the conveyor belt 230 can be prevented from being shifted in a direction perpendicular to the direction indicated by arrow 230*a* by the engagement of the convex portions 231 and 233 intermittently disposed on the inner circumferential surface of the conveyor belt 230 with the concave portions 241 and 242 of the conveyor belt drive roller 240, the concave portions 251 and 252 of the conveyor belt pressure roller 250, and the concave portions 261 and 262 of the conveyor belt driven roller 260, respectively. Therefore, the rotation of the conveyor belt 230 can be surely synchronized with the rotations of the conveyor belt drive roller 240, the conveyor belt pressure roller 250, and the conveyor belt driven roller 260. Consequently, the flatness of the outer circumferential surface of the conveyor belt 230 can be maintained, so that the conveyor belt 230 can stably convey an original document to the image reading position 91. Although the conveyor belt 230 includes the two rows 232 and 234 of the convex portions 231 and 233, respectively, the conveyor belt 230 may include three rows of convex portions or more.

Each of the end portions 235 and 236 of the conveyor belt 230 has a lower rigidity than other portions of the conveyor belt 230 and tends to become deformed. In the auto document feeder 10 of the present embodiment, the conveyor belt 230 does not include the row 232 of the convex portions 231 and the row 234 of the convex portions 233 at the end portions 235 and 236, respectively. Therefore, the convex portions 231 can be prevented from being disengaged from the concave portion 241 of the conveyor belt drive roller 240, the concave portion 251 of the conveyor belt pressure roller 250, and the concave portion 261 of the conveyor belt driven roller 260. Further, the convex portions 233 can be prevented from being disengaged from the concave portion 242 of the conveyor belt drive roller 240, the concave portion 252 of the conveyor belt pressure roller 250, and the concave portion 262 of the conveyor belt driven roller 260. Thus, the conveyor belt 230 can stably convey an original document to the image reading position 91.

Next, a configuration of an auto document feeder according to another example embodiment of the present invention is described. The auto document feeder 10 of this embodiment includes a conveyor belt drive roller 340, a conveyor belt pressure roller 350, and a conveyor belt driven roller 360 illustrated in FIG. 23, in place of the conveyor belt drive roller 240, the conveyor belt pressure roller 250, and the conveyor belt driven roller 260 illustrated in FIG. 21.

Figure 23:
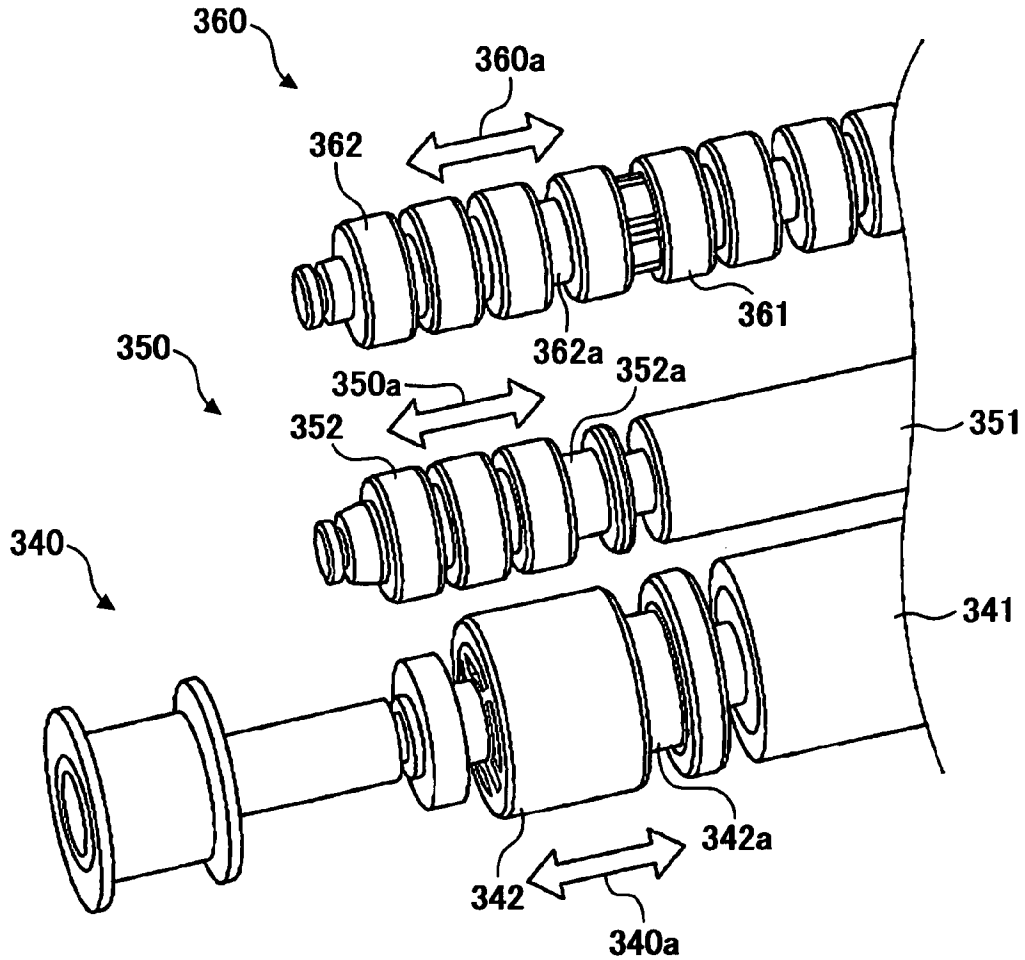
FIG. 23 is a partial perspective view of a conveyor belt drive roller, a conveyor belt pressure roller, and a conveyor belt driven roller according to another example embodiment of the present invention.

As illustrated in FIG. 23, the conveyor belt drive roller 340 includes a main roller 341 and an auxiliary roller 342. The auxiliary roller 342 has a coaxial relationship relative to the main roller 341 and is supported by the main roller 341 such that the auxiliary roller 342 can move in an axial direction of the conveyor belt drive roller 340 indicated by arrow 340*a* in FIG. 23. The main roller 341 includes a concave portion 341*a* (shown in FIGS. 24A and 24B) on its outer circumferential surface. The auxiliary roller 342 includes a concave portion 342*a* (shown in FIGS. 23, 24A, and 24B) on its outer circumferential surface.

Likewise, as illustrated in FIG. 23, the conveyor belt pressure roller 350 includes a main roller 351 and an auxiliary roller 352. The auxiliary roller 352 has a coaxial relationship relative to the main roller 351 and is supported by the main roller 351 such that the auxiliary roller 352 can move in an axial direction of the conveyor belt pressure roller 350 indicated by arrow 350*a* in FIG. 23. The main roller 351 includes a concave portion (not shown) on its outer circumferential surface. The auxiliary roller 352 includes a concave portion 352*a* on its outer circumferential surface.

Likewise, as illustrated in FIG. 23, the conveyor belt driven roller 360 includes a main roller 361 and an auxiliary roller 362. The auxiliary roller 362 has a coaxial relationship relative to the main roller 361 and is supported by the main roller 361 such that the auxiliary roller 362 can move in an axial direction of the conveyor belt driven roller 360 indicated by arrow 360*a* in FIG. 23. The main roller 361 includes a concave portion (not shown) on its outer circumferential surface. The auxiliary roller 362 includes a concave portion 362*a* on its outer circumferential surface.

Figure 24A:
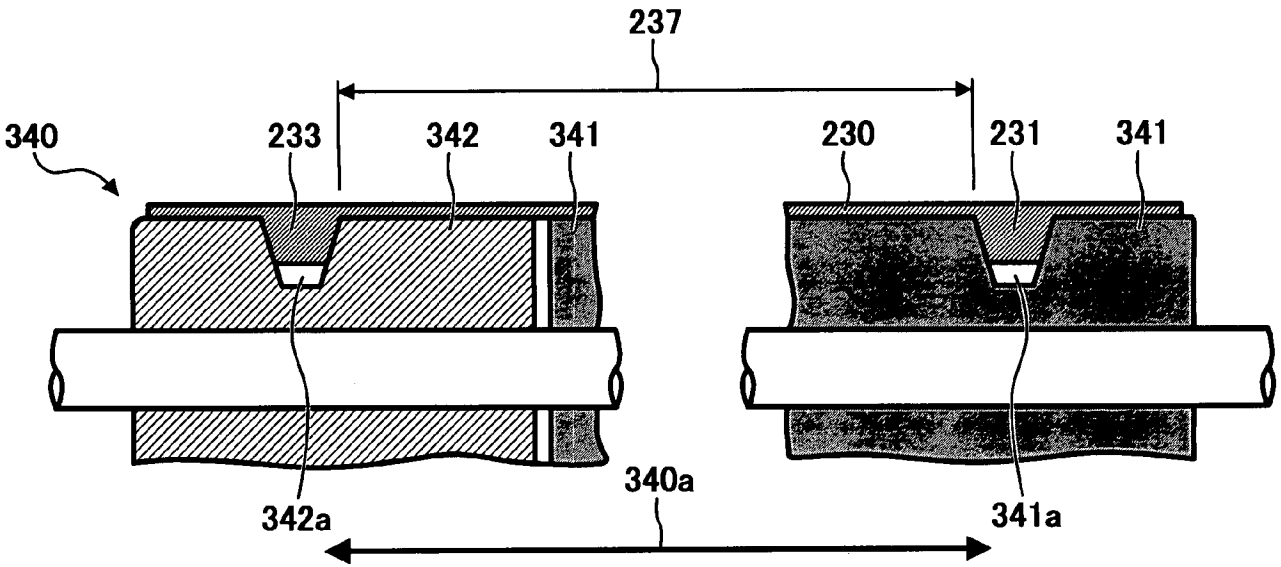
FIG. 24A is a side view of a conveyor belt and a conveyor belt drive roller according to another example embodiment of the present invention.
Figure 24B:
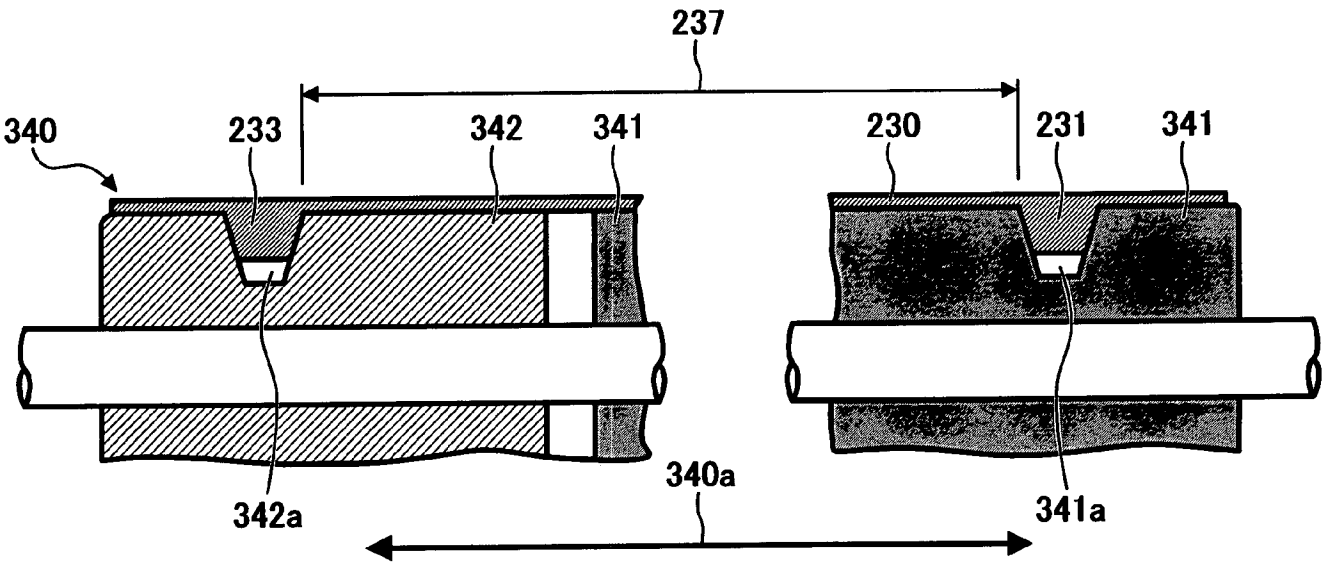
FIG. 24B is a side view of a conveyor belt and a conveyor belt drive roller, in which a distance between convex portions of the conveyor belt in a direction along the width of the conveyor belt is greater than that in FIG. 24A.

Similarly to the conveyor belt 230 of FIG. 22, the conveyor belt 230 is spanned around the conveyor belt drive roller 340, the conveyor belt pressure roller 350, and the conveyor belt driven roller 360 such that a direction substantially perpendicular to the original document conveying direction equals an axial direction of each of the conveyor belt drive roller 340, the conveyor belt pressure roller 350, and the conveyor belt driven roller 360. Even if the size tolerance of the conveyor belt 230 is difficult to be strictly controlled in view of a manufacturing method and if a distance 237 between the convex portions 231 and 233 has an error in the axial direction indicated by arrow 340*a* of the conveyor belt drive roller 340 as illustrated in FIGS. 24A and 24B, the convex portions 231 and convex portions 233 of the conveyor belt 230 can be securely engaged in the concave portion 341*a* of the main roller 341 and the concave portion 342*a* of the auxiliary roller 342, respectively, because the auxiliary roller 342 can move in the axial direction indicated by arrow 340*a* of the conveyor belt drive roller 340.

Likewise, because the auxiliary roller 352 can move in the axial direction indicated by arrow 350*a* of the conveyor belt pressure roller 350, the convex portions 231 and convex portions 233 of the conveyor belt 230 can be securely engaged in the concave portion of the main roller 351 and the concave portion 352*a* of the auxiliary roller 352, respectively.

Likewise, because the auxiliary roller 362 can move in the axial direction indicated by arrow 360*a* of the conveyor belt driven roller 360, the convex portions 231 and convex portions 233 of the conveyor belt 230 can be securely engaged in the concave portion of the main roller 361 and the concave portion 362*a* of the auxiliary roller 362, respectively.

As described above, in the auto document feeder 10 of the present embodiment, even if the size tolerance of the conveyor belt 230 is difficult to be strictly controlled in view of a manufacturing method, the convex portions 231 of the conveyor belt 230 can be securely engaged in the concave portion 341*a* of the conveyor belt drive roller 340, the concave portion of the conveyor belt pressure roller 350, and the concave portion of the conveyor belt driven roller 360. Further, the convex portions 233 of the conveyor belt 230 can be securely engaged in the concave portion 342*a* of the conveyor belt drive roller 340, the concave portion 352*a* of the conveyor belt pressure roller 350, and the concave portion 362*a* of the conveyor belt driven roller 360. Thus, the flatness of the outer circumferential surface of the conveyor belt 230 can be maintained, so that the conveyor belt 230 can stably convey an original document to the image reading position 91.

Figure 25:
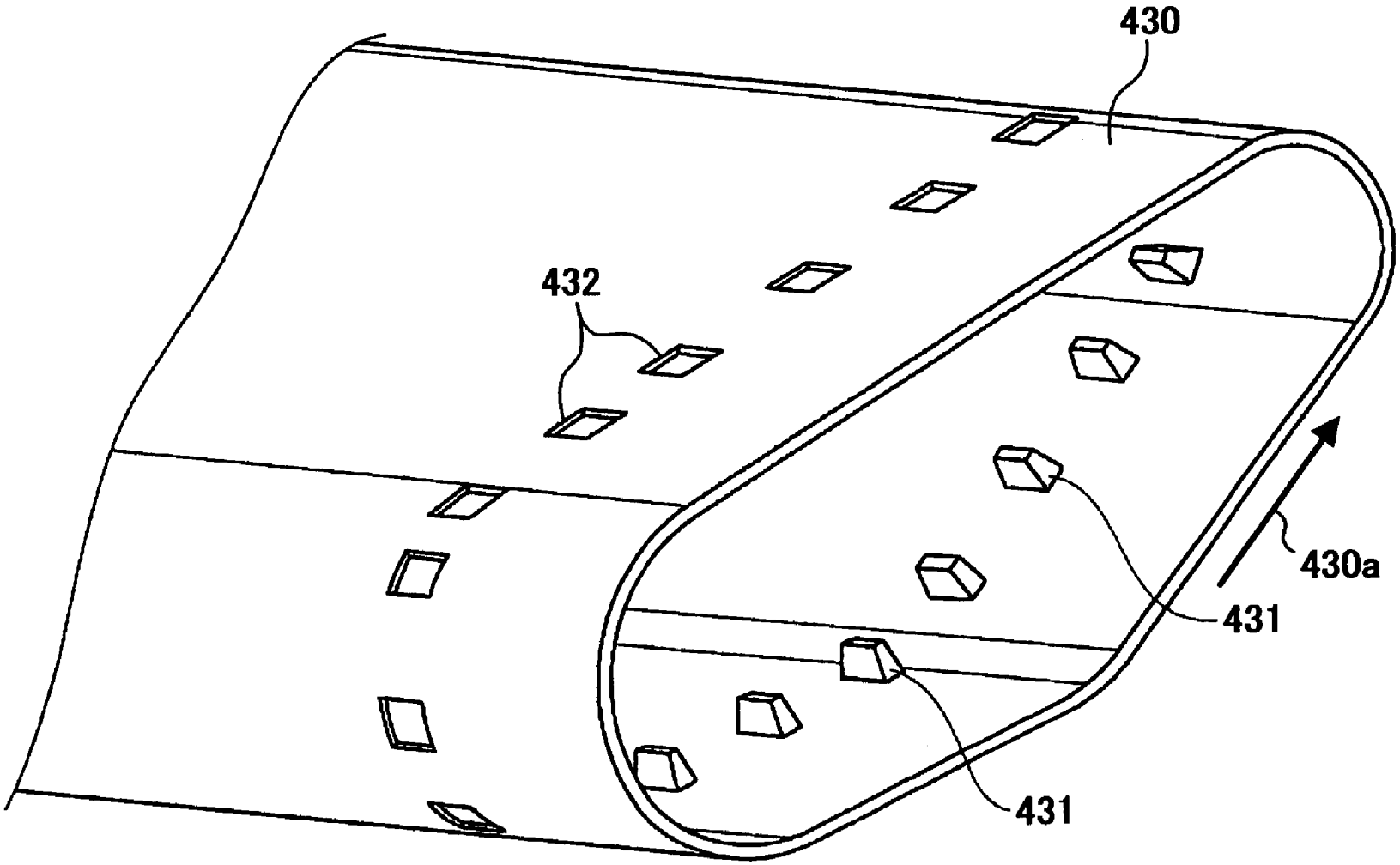
FIG. 25 is a perspective view of a conveyor belt according to another example embodiment of the present invention.

FIG. 25 is a perspective view of a conveyor belt according to another example embodiment of the present invention. Similarly to the conveyor belt 230 of FIG. 19, a conveyor belt 430 includes a row of convex portions 431 intermittently arranged on its inner circumferential surface in an original document conveying direction indicated by arrow 430*a* in FIG. 25 at a position away from an end portion of the conveyor belt 430 in a direction perpendicular to the original document conveying direction. Although not shown, the conveyor belt 430 includes another row of convex portions intermittently arranged on its inner circumferential surface in the original document conveying direction indicated by arrow 430*a* at a position away from another end portion of the conveyor belt 430 in the direction perpendicular to the original document conveying direction. The convex portions 431 are engaged in the concave portion 241 of the conveyor belt drive roller 240, the concave portion 251 of the conveyor belt pressure roller 250, and the concave portion 261 of the conveyor belt driven roller 260, respectively, which are shown in FIG. 21. Further, the convex portions of another row of the conveyor belt 430 are engaged in the concave portion 242 of the conveyor belt drive roller 240, the concave portion 252 of the conveyor belt pressure roller 250, and the concave portion 262 of the conveyor belt driven roller 260, respectively. Alternatively, the convex portions of the conveyor belt 430 may be engaged in the concave portions of the conveyor belt drive roller 340, the concave portions of the conveyor belt pressure roller 350, and the concave portions of the conveyor belt driven roller 360, respectively, as shown in FIG. 23. By these engagements, the conveyor belt 430 can be prevented from being shifted in the direction perpendicular to the original document conveying direction indicated by arrow 430*a*.

On the outer circumferential surface of the conveyor belt 430, recess portions 432 are provided at positions opposing base portions of the convex portions 431 provided on the inner circumferential surface of the conveyor belt 430.

Figure 26A:
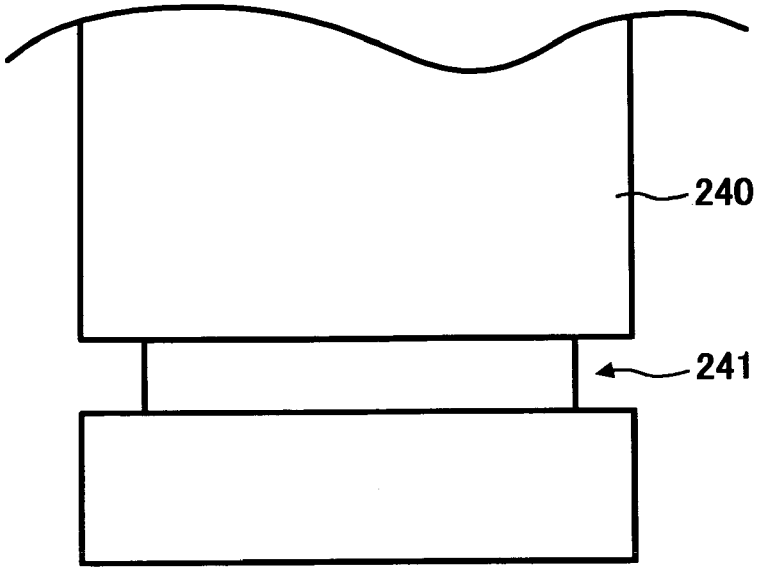
FIG. 26A is a top view of the conveyor belt drive roller of FIG. 21.
Figure 26B:
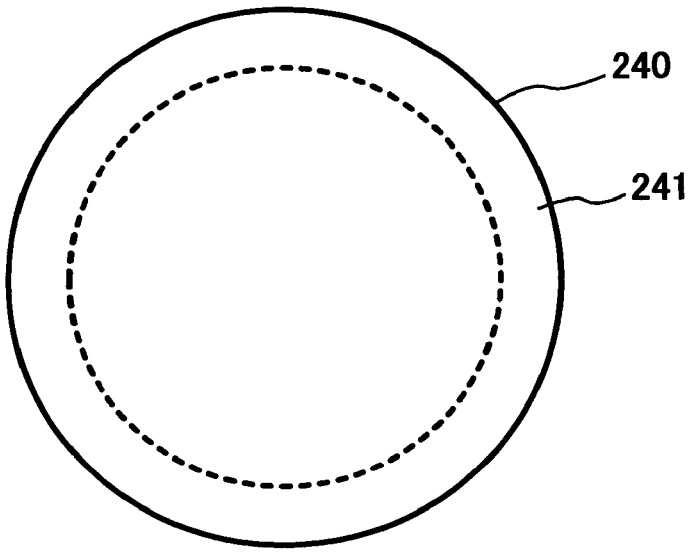
FIG. 26B is a side view of the conveyor belt drive roller of FIG. 21.
Figure 27A:
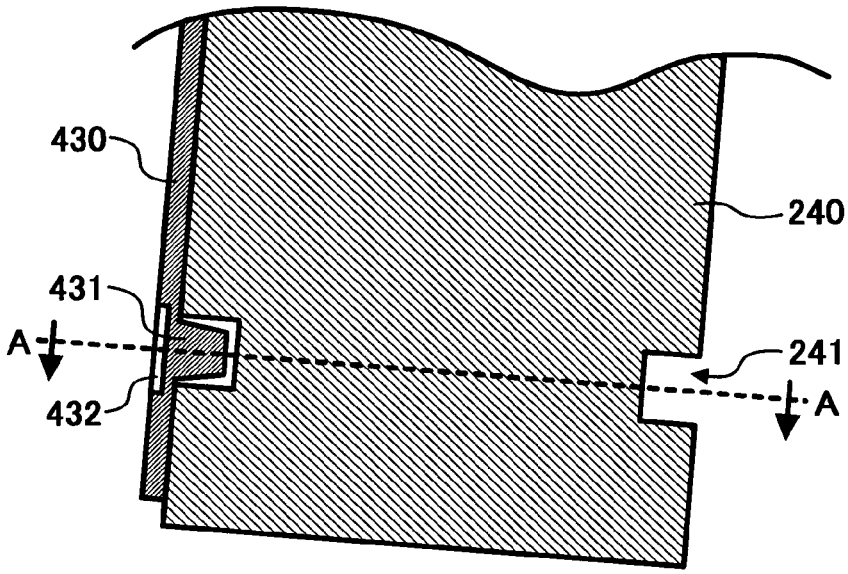
FIG. 27A is a cross-sectional view of the conveyor belt drive roller around which the conveyor belt is partially spanned, taken on line B-B of FIG. 27B.
Figure 27B:
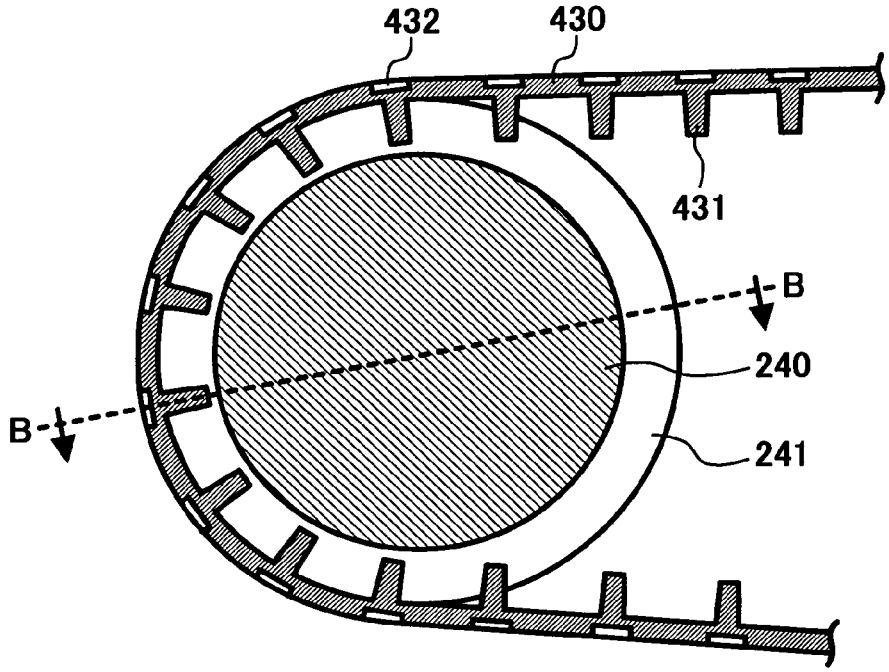
FIG. 27B is a cross-sectional view of the conveyor belt drive roller around which the conveyor belt is partially spanned, taken on line A-A of FIG. 27A.

FIG. 26A is a top view of the conveyor belt drive roller 240, and FIG. 26B is a side view of the conveyor belt drive roller 240. FIG. 27A is a cross-sectional view of the conveyor belt drive roller 240 around which the conveyor belt 430 is partially spanned, taken on line B-B of FIG. 27B. FIG. 27B is a cross-sectional view of the conveyor belt drive roller 240 around which the conveyor belt 430 is partially spanned, taken on line A-A of FIG. 27A. As illustrated in FIGS. 26A and 26B and FIGS. 27A and 27B, the concave portion 241 is formed on the outer circumferential surface of the conveyor belt drive roller 240 at a position near one end portion of the conveyor belt drive roller 240. A depth of the concave portion 241 is set to be greater than a height of the convex portion 431 such that the top surface of the convex portion 431 does not contact the bottom surface of the concave portion 241. The width of the concave portion 241 is substantially equal to or slightly greater than a width of the base portion of the convex portion 431. As such, the convex portions 431 can be smoothly inserted in and removed from the concave portion 241 during the rotation of the conveyor belt drive roller 240. Although FIGS. 26A and 27A illustrate only one side end portion of the conveyor belt drive roller 240, the other end portion is configured similarly as the just described. Further, a depth of each of the concave portion 242 of the conveyor belt drive roller 240, the concave portions 251 and 252 of the conveyor belt pressure roller 250, and the concave portions 261 and 262 of the conveyor belt driven roller 260 is also set to be greater than the height of the convex portion 431.

Figure 28:
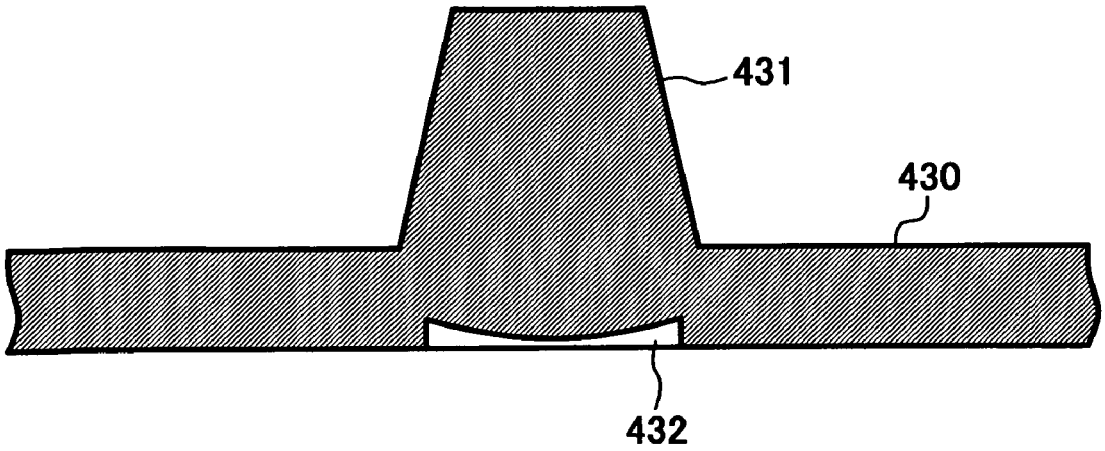
FIG. 28 is a cross section of a conveyor belt including a convex portion and a recess portion according to another embodiment of the present invention.

FIG. 28 is a cross-sectional view of the conveyor belt 430 on which the convex portion 431 and the recess portion 432 are provided. The shape of the cross section of each of the convex portion 431 and the recess portion 432 is the same in either the circumferential direction or the width direction of the conveyor belt 430. The width of the recess portion 432 is substantially equal to the width of the convex portion 431. The recess portion 432 has a form that covers the base portion of the convex portion 431.

The base portion of the convex portion 431 protrudes toward the outer circumferential surface side of the conveyor belt 430 by a tensile force exerted on the conveyor belt 430 stretched around the conveyor belt drive roller 240, the conveyor belt pressure roller 250, and the conveyor belt driven roller 260 as described above with reference to FIG. 1. However, the recess portion 432 formed on the outer circumferential surface of the conveyor belt 430 absorbs such a protrusion of the base portion of the convex portion 431, so that the base portion of the convex portion 431 does not protrude or uplift from the outer circumferential surface of the conveyor belt 430. Consequently, the flatness of the outer circumferential surface of the conveyor belt 430 can be maintained, so that the conveyor belt 430 can stably convey an original document.

The protrusion of the base portion of the convex portion 431 significantly occurs at the center portion of the convex portion 431. Therefore, even if the width of the recess portion 432 is slightly smaller than the width of the convex portion 431, the recess portion 432 absorbs the protrusion of the base portion of the convex portion 431. As a result, the base portion of the convex portion 431 does not protrude or uplift from the outer circumferential surface of the conveyor belt 430. Thus, the flatness of the outer circumferential surface of the conveyor belt 430 can be maintained, so that the conveyor belt 430 can stably convey an original document.

Figure 29:
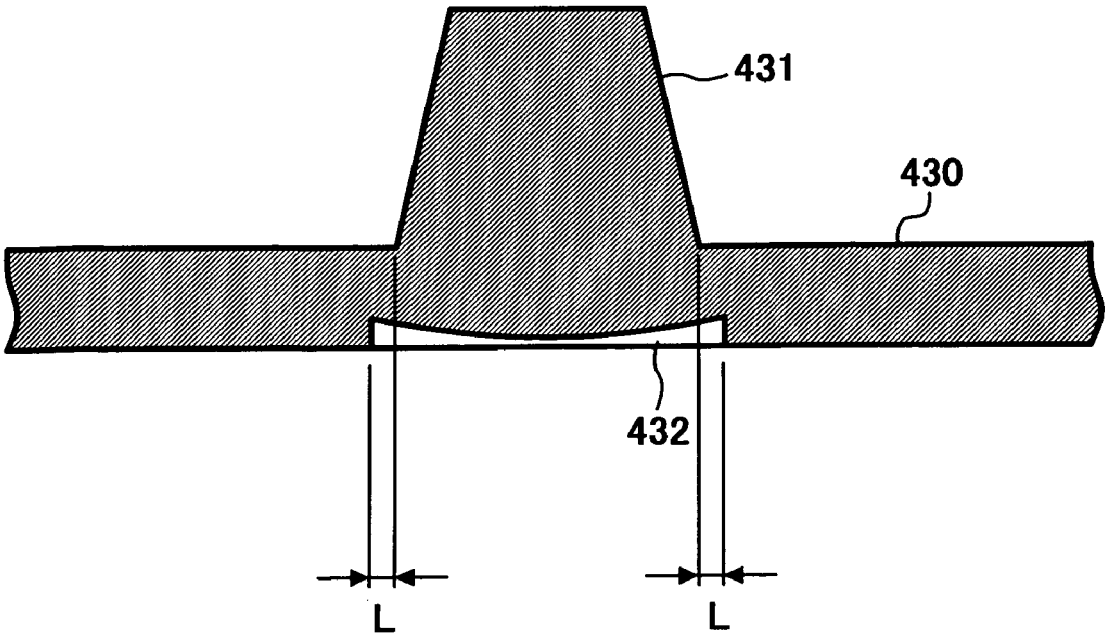
FIG. 29 is a cross section of a conveyor belt including a convex portion and a recess portion, in which a width of the recess portion is set to be greater than a width of a bottom portion of the convex portion.

As a non-limiting example, the width of the recess portion 432 is preferably greater than the width of the convex portion 431 as illustrated in FIG. 29. In FIG. 29, the width of the recess portion 432 is set to be greater than the width of the bottom portion of the convex portion 431 each by a length "L" on both end sides of the bottom portion in the circumferential direction of the conveyor belt 430. As such, the recess portion 432 surely absorbs the protrusion of the base portion of the convex portion 431 toward the outer circumferential surface side of the conveyor belt 430. As a result, the base portion of the convex portion 431 does not protrude or uplift from the outer circumferential surface of the conveyor belt 430. Thus, the flatness of the outer circumferential surface of the conveyor belt 430 can be maintained, so that the conveyor belt 430 can stably convey an original document.

Figure 30:
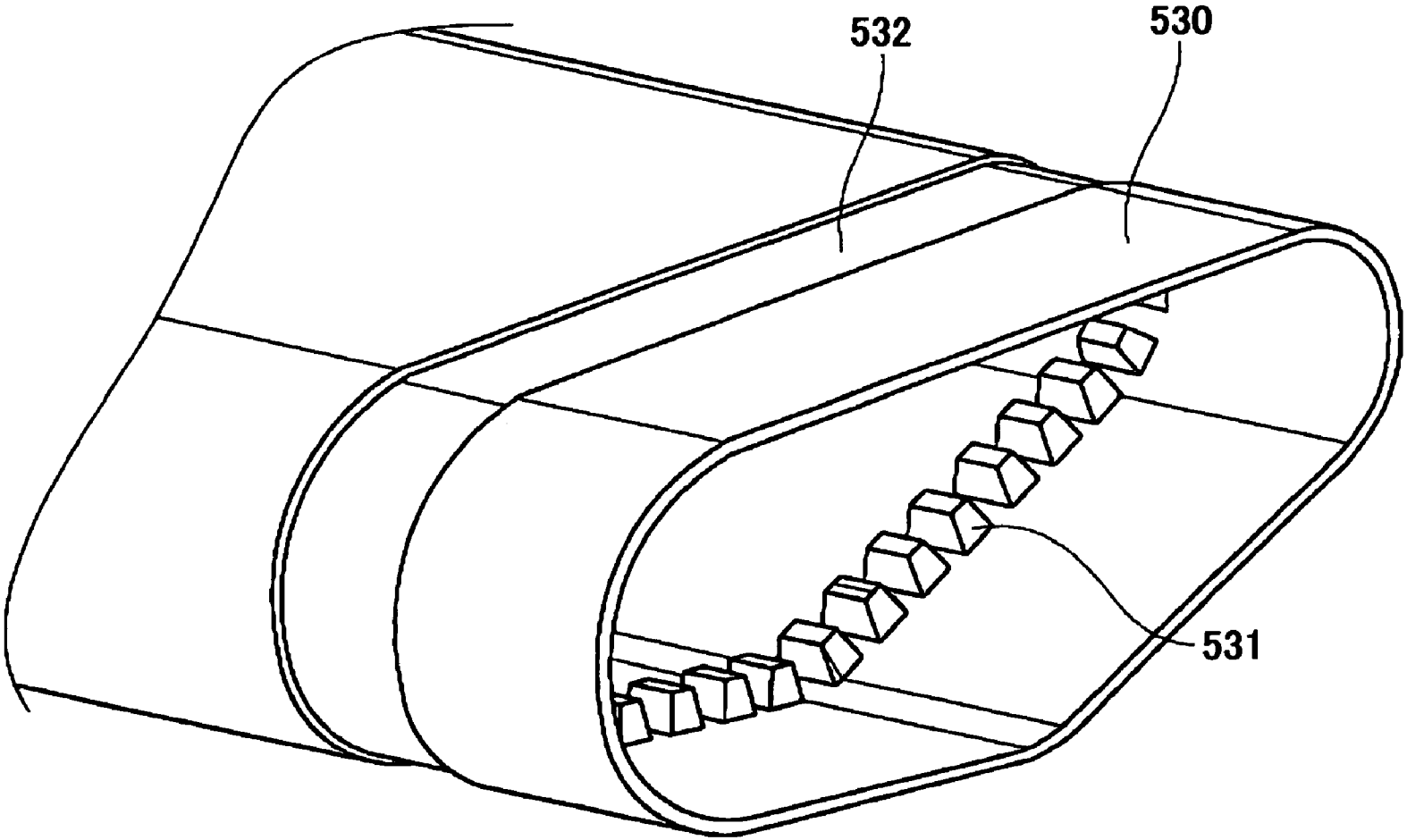
FIG. 30 is a perspective view of a conveyor belt according to another example embodiment of the present invention.

FIG. 30 is a perspective view of a conveyor belt 530 including convex portions 531 which are formed on the inner circumferential surface of the conveyor belt 530 such that intervals between any of the two adjacent convex portions 531 are less than intervals between any of the two adjacent convex portions 431 of the conveyor belt 430 of FIG. 25. In the conveyor belt 430 of FIG. 25, because intervals between any of the two adjacent convex portions 431 are greater than the intervals between any of the two adjacent convex portions 531 of the conveyor belt 530 of FIG. 30, the recess portions 432 are formed independently, corresponding to the convex portions 431. In the conveyor belt 530 of FIG. 30, because the intervals between any of the two adjacent convex portions 531 are small, adjacent recess portions are united, that is, a continuous recess 532 extending in the circumferential direction of the conveyor belt 530 is formed on the outer circumferential surface of the conveyor belt 530 as illustrated in FIG. 30. Similarly to the concave portion 432 of FIGS. 28 and 29, the recess 532 absorbs the protrusion of the base portions of the convex portions 531 toward the outer circumferential surface side of the conveyor belt 530. As a result, the base portion of the convex portion 531 does not protrude or uplift from the outer circumferential surface of the conveyor belt 530. Consequently, the flatness of the outer circumferential surface of the conveyor belt 530 can be maintained, so that the conveyor belt 530 can stably convey an original document.

The above-described convex portions 31, 131, 231, 233, 431, and 531 of the conveyor belt may be integrally formed in a metal mold. Alternatively, the convex portions 31, 131, 231, 233, 431, and 531 of the conveyor belt may be formed by a cutting process, or the convex portions 31, 131, 231, 233, 431, and 531 may be attached onto the surface of the conveyor belt.

Further, the convex portions 431 and the recess portions 432 of the conveyor belt 430 may be integrally formed in a metal mold. Alternatively, the convex portions 431 and the recess portions 432 of the conveyor belt 430 may be formed by a cutting process. Further, the convex portions 431 may be attached onto the surface of the conveyor belt 430 and the recess portions 432 may be formed by a cutting process. These production methods can be applied to the convex portions 531 and the continuous recess 532 of the conveyor belt 530.

According to the above-described example embodiments of the present invention, the conveyor belt can stably convey an original document to the image reading position 91. Therefore, an image of an original document can be read properly at the image reading position 91 by the image reading device 740, and deterioration of image quality caused by a sheet conveyance failure can be avoided.

The present invention has been described with respect to the exemplary embodiments illustrated in the figures. However, the present invention is not limited to these embodiments and may be practiced otherwise.

The cross section of each of the convex portions 31, 131, 231, 233, 431, and 531 is not limited to a trapezoidal shape, and may have any shape so long as a width of each of the convex portions decreases from a bottom surface toward a top surface of each of the convex portions.

The auto document feeder 10 may feed and convey any type of sheet-like members having an image.

Numerous additional modifications and variations of the present invention are possible in light of the above teachings. It is therefore to be understood that within the scope of the appended claims, the present invention may be practiced otherwise than as specifically described herein.

What is claimed:

1. A sheet feeding device, comprising:

a conveyor belt configured to convey a sheet, the conveyor belt comprising a first row of a plurality of convex portions intermittently arranged on an inner circumferential surface of the conveyor belt in a sheet conveying direction; and at least three rollers arranged substantially in a row along the sheet conveying direction and around which the conveyor belt is spanned such that a direction substantially perpendicular to the sheet conveying direction is substantially parallel to an axial direction of each of the rollers, wherein the at least three rollers include an upstream-most roller, a downstream-most roller, and at least one further roller located between said upstream-most roller and said downstream-most roller in the sheet conveying direction, wherein all of the rollers comprise first concave portions on outer circumferential surfaces thereof, in which the convex portions of the first row of the conveyor belt are engaged, and wherein a width of the first concave portion of at least one of said upstream-most roller and said downstream-most roller is smaller than a width of the first concave portions of the at least one further roller.

2. The sheet feeding device according to claim 1, wherein the plurality of rollers comprise a drive roller, and a width of the first concave portion of the drive roller is smaller than the width of the first concave portions of the other rollers of the plurality.

3. The sheet feeding device according to claim 1, wherein the plurality of rollers comprise a driven roller, and a width of the first concave portion of the driven roller is smaller than the width of the first concave portions of the other rollers of the plurality.

4. The sheet feeding device according to claim 1, wherein a width of each of the plurality of convex portions decreases from a bottom side toward a top side of each of the plurality of convex portions.

5. The sheet feeding device according to claim 1, wherein the first row of the plurality of convex portions is disposed at a position other than end portions of the conveyor belt in a direction substantially perpendicular to the sheet conveying direction.

6. The sheet feeding device according to claim 1, wherein the conveyor belt further comprises a second row of a plurality of convex portions intermittently arranged on the inner circumferential surface of the conveyor belt in the sheet conveying direction, and the plurality of rollers further comprise second concave portions on the outer circumferential surfaces of the rollers in which the convex portions of the second row of the conveyor belt are engaged.

7. The sheet feeding device according to claim 1, wherein intervals between any two adjacent convex portions are uneven.

8. An image forming apparatus, comprising:

an image reading device configured to read an image of an original document at an image reading position;

an image forming device configured to form a duplicate of the image read by the image reading device; and a sheet feeding device configured to feed the original document to the image reading position, the sheet feeding device comprising, a conveyor belt configured to convey the original document, the conveyor belt comprising a first row of a plurality of convex portions intermittently arranged on an inner circumferential surface of the conveyor belt in an original document conveying direction; and at least three rollers arranged substantially in a row along the sheet conveying direction and around which the conveyor belt is spanned such that a direction substantially perpendicular to the original document conveying direction is substantially parallel to an axial direction of each of the rollers, wherein the at least three rollers include an upstream-most roller, a downstream-most roller, and at least one further roller located between said upstream-most roller and said downstream-most roller in the sheet conveying direction, wherein all of the rollers comprise first concave portions on outer circumferential surfaces thereof, in which the convex portions of the first row of the conveyor belt are engaged, and wherein a width of the first concave portion of at least one of said upstream-most roller and said downstream-most roller is smaller than a width of the first concave portions of the at least one further roller.

9. The image forming apparatus according to claim 8, wherein the plurality of rollers comprise a drive roller, and a width of the first concave portion of the drive roller is smaller than the width of the first concave portions of the other rollers of the plurality.

10. The image forming apparatus according to claim 8, wherein the plurality of rollers comprise a driven roller, and a width of the first concave portion of the driven roller is smaller than the width of the first concave portions of the other rollers of the plurality.

11. The image forming apparatus according to claim 8, wherein a width of each of the plurality of convex portions decreases from a bottom side toward a top side of each of the plurality of convex portions.

12. The image forming apparatus according to claim 8, wherein the first row of the plurality of convex portions is disposed at a position other than end portions of the conveyor belt in a direction substantially perpendicular to the original document conveying direction.

13. The image forming apparatus according to claim 8, wherein the conveyor belt further comprises a second row of a plurality of convex portions intermittently arranged on the inner circumferential surface of the conveyor belt in the original document conveying direction, and the plurality of rollers further comprises second concave portions on the outer circumferential surfaces of the rollers in which the convex portions of the second row of the conveyor belt are engaged.

14. The image forming apparatus according to claim 8, wherein intervals between any two adjacent convex portions are uneven.

15. The sheet feeding device according to claim 1, wherein the least one of said upstream-most roller and said downstream-most roller is said upstream-most roller.

16. The sheet feeding device according to claim 1, wherein the least one of said upstream-most roller and said downstream-most roller is said downstream-most roller.

17. The image forming apparatus according to claim 8, wherein the least one of said upstream-most roller and said downstream-most roller is said upstream-most roller.

18. The image forming apparatus according to claim 8, wherein the least one of said upstream-most roller and said downstream-most roller is said downstream-most roller.

* * * * *